US011759853B2

(12) United States Patent
Cooper

(10) Patent No.: US 11,759,853 B2
(45) **Date of Patent: *Sep. 19, 2023**

(54) MELTING METAL ON A RAISED SURFACE

(71) Applicant: Molten Metal Equipment Innovations, LLC, Middlefield, OH (US)

(72) Inventor: Paul V. Cooper, Chesterland, OH (US)

(73) Assignee: Molten Metal Equipment Innovations, LLC, Middlefield, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/692,117

(22) Filed: Mar. 10, 2022

(65) Prior Publication Data

US 2022/0193764 A1 Jun. 23, 2022

Related U.S. Application Data

(63) Continuation of application No. 16/877,219, filed on May 18, 2020, now Pat. No. 11,358,217.

(Continued)

(51) Int. Cl.

*B22D 41/00* (2006.01)
*B22D 35/04* (2006.01)

(Continued)

(52) U.S. Cl.

CPC ..... *B22D 41/00* (2013.01); *B22D 35/04* (2013.01); *B22D 39/02* (2013.01); *F04D 7/065* (2013.01);

(Continued)

(58) Field of Classification Search

CPC . F04D 7/065; F27B 3/045; F27D 3/14; F27D 27/005; F27D 2003/0054; B22D 41/00; B22D 35/04

See application file for complete search history.

(56) References Cited

U.S. PATENT DOCUMENTS 35,604 A 6/1862 Guild
116,797 A 7/1871 Barnhart (Continued)

FOREIGN PATENT DOCUMENTS

CA 683469 3/1964
CA 2115929 8/1992

(Continued)

OTHER PUBLICATIONS

"Response to Final Office Action and Request for Continued Examination for U.S. Appl. No. 09/275,627," including Declarations of Haynes and Johnson, dated Apr. 16, 2001.

(Continued)

*Primary Examiner* — Scott R Kastler
(74) *Attorney, Agent, or Firm* — Snell & Wilmer L.L.P.

(57) ABSTRACT

A scrap melting system and method includes a vessel that is configured to retain molten metal and a raised surface about the level of molten metal in the vessel. Solid metal is placed on the raised surface and molten metal from the vessel is moved upward from the vessel and across the raised surface to melt at least some of the solid metal. The molten metal is preferably raised from the vessel to the raised surface by a molten metal pumping device or system. The molten metal moves from the raised surface and into a vessel or launder.

16 Claims, 13 Drawing Sheets

Related U.S. Application Data

(60) Provisional application No. 62/852,846, filed on May 24, 2019, provisional application No. 62/849,787, filed on May 17, 2019.

(51) Int. Cl.

| | |
|---|---|
| ***F04D 7/06*** | (2006.01) |
| ***F27D 3/14*** | (2006.01) |
| ***F27D 27/00*** | (2010.01) |
| ***F27B 3/04*** | (2006.01) |
| ***B22D 39/02*** | (2006.01) |
| ***F04D 29/02*** | (2006.01) |
| ***B22D 39/00*** | (2006.01) |
| ***F27D 3/00*** | (2006.01) |
| ***F04D 29/42*** | (2006.01) |

(52) U.S. Cl.

CPC ..... *F04D 29/026* (2013.01); *F27B 3/045* (2013.01); *F27D 3/14* (2013.01); *F27D 27/005* (2013.01); *B22D 39/00* (2013.01); *F04D 29/426* (2013.01); *F27D 2003/0054* (2013.01); *F27M 2001/012* (2013.01)

(56) References Cited

U.S. PATENT DOCUMENTS 209,219 A 10/1878 Bookwalter
251,104 A 12/1881 Finch
307,845 A 11/1884 Curtis
364,804 A 6/1887 Cole
390,319 A 10/1888 Thomson
495,760 A 4/1893 Seitz
506,572 A 10/1893 Wagener
585,188 A 6/1897 Davis
757,932 A 4/1904 Jones
882,477 A 3/1908 Neumann
882,478 A 3/1908 Neumann
890,319 A 6/1908 Wells
898,499 A 9/1908 O'Donnell
909,774 A 1/1909 Flora
919,194 A 4/1909 Livingston
1,037,659 A 9/1912 Rembert
1,100,475 A 6/1914 Franckaerts
1,170,512 A 2/1916 Chapman
1,196,758 A 9/1916 Blair
1,304,068 A 5/1919 Krogh
1,331,997 A 2/1920 Neal
1,185,314 A 3/1920 London
1,377,101 A 5/1921 Sparling
1,380,798 A 6/1921 Hansen et al.
1,439,365 A 12/1922 Hazell
1,454,967 A 5/1923 Gill
1,470,607 A 10/1923 Hazell
1,513,875 A 11/1924 Wilke
1,518,501 A 12/1924 Gill
1,522,765 A 1/1925 Wilke
1,526,851 A 2/1925 Hall
1,669,668 A 5/1928 Marshall
1,673,594 A 6/1928 Schmidt
1,697,202 A 1/1929 Nagle
1,717,969 A 6/1929 Goodner
1,718,396 A 6/1929 Wheeler
1,896,201 A 2/1933 Sterner-Rainer
1,988,875 A 1/1935 Saborio
2,013,455 A 9/1935 Baxter
2,035,282 A 3/1936 Schmeller, Sr.
2,038,221 A 4/1936 Kagi
2,075,633 A 3/1937 Anderegg
2,090,162 A 8/1937 Tighe
2,091,677 A 8/1937 Fredericks
2,138,814 A 12/1938 Bressler
2,173,377 A 9/1939 Schultz, Jr. et al.
2,264,740 A 12/1941 Brown
2,280,979 A 4/1942 Rocke
2,290,961 A 7/1942 Heuer
2,300,688 A 11/1942 Nagle
2,304,849 A 12/1942 Ruthman
2,368,962 A 2/1945 Blom
2,383,424 A 8/1945 Stepanoff
2,423,655 A 7/1947 Mars et al.
2,488,447 A 11/1949 Tangen et al.
2,493,467 A 1/1950 Sunnen
2,515,097 A 7/1950 Schryber
2,515,478 A 7/1950 Tooley et al.
2,528,208 A 10/1950 Bonsack et al.
2,528,210 A 10/1950 Stewart
2,543,633 A 2/1951 Lamphere
2,566,892 A 4/1951 Jacobs
2,625,720 A 1/1953 Ross
2,626,086 A 1/1953 Forrest
2,676,279 A 4/1954 Wilson
2,677,609 A 4/1954 Moore et al.
2,698,583 A 1/1955 House et al.
2,714,354 A 8/1955 Farrand
2,762,095 A 9/1956 Pemetzrieder
2,768,587 A 10/1956 Corneil
2,775,348 A 12/1956 Williams
2,779,574 A 1/1957 Schneider
2,787,873 A 4/1957 Hadley
2,808,782 A 10/1957 Thompson et al.
2,809,107 A 10/1957 Russell
2,821,472 A 1/1958 Peterson et al.
2,824,520 A 2/1958 Bartels
2,832,292 A 4/1958 Edwards
2,839,006 A 6/1958 Mayo
2,853,019 A 9/1958 Thornton
2,865,295 A 12/1958 Nikolaus
2,865,618 A 12/1958 Abell
2,868,132 A 1/1959 Rittershofer
2,901,006 A 8/1959 Andrews
2,901,677 A 8/1959 Chessman et al.
2,906,632 A 9/1959 Nickerson
2,918,876 A 12/1959 Howe
2,948,524 A 8/1960 Sweeney et al.
2,958,293 A 11/1960 Pray, Jr.
2,966,345 A 12/1960 Burgoon et al.
2,966,381 A 12/1960 Menzel
2,978,885 A 4/1961 Davison
2,984,524 A 5/1961 Franzen
2,987,885 A 6/1961 Hodge
3,010,402 A 11/1961 King
3,015,190 A 1/1962 Arbeit
3,039,864 A 6/1962 Hess
3,044,408 A 7/1962 Mellott
3,048,384 A 8/1962 Sweeney et al.
3,070,393 A 12/1962 Silverberg et al.
3,092,030 A 6/1963 Wunder
3,099,870 A 8/1963 Seeler
3,128,327 A 4/1964 Upton
3,130,678 A 4/1964 Chenault
3,130,679 A 4/1964 Sence
3,151,565 A 10/1964 Albertson et al.
3,171,357 A 3/1965 Egger
3,172,850 A 3/1965 Englesberg et al.
3,203,182 A 8/1965 Pohl
3,227,547 A 1/1966 Szekely
3,244,109 A 4/1966 Barske
3,251,676 A 5/1966 Johnson
3,255,702 A 6/1966 Gehrm
3,258,283 A 6/1966 Winberg et al.
3,272,619 A 9/1966 Sweeney et al.
3,289,473 A 12/1966 Londa
3,291,473 A 12/1966 Sweeney et al.
3,368,805 A 2/1968 Davey et al.
3,374,943 A 3/1968 Cervenka
3,400,923 A 9/1968 Howie et al.
3,417,929 A 12/1968 Secrest et al.
3,432,336 A 3/1969 Langrod et al.
3,459,133 A 8/1969 Scheffler
3,459,346 A 8/1969 Tinnes
3,477,383 A 11/1969 Rawson et al.
3,487,805 A 1/1970 Satterthwaite
3,512,762 A 5/1970 Umbricht

(56) References Cited

U.S. PATENT DOCUMENTS 3,512,788 A 5/1970 Kilbane
3,532,445 A 10/1970 Scheffler et al.
3,561,885 A 2/1971 Lake
3,575,525 A 4/1971 Fox et al.
3,581,767 A 6/1971 Jackson
3,612,715 A 10/1971 Yedidiah
3,618,917 A 11/1971 Fredrikson et al.
3,620,716 A 11/1971 Hess
3,650,730 A 3/1972 Derham et al.
3,689,048 A 9/1972 Foulard et al.
3,715,112 A 2/1973 Carbonnel
3,732,032 A 5/1973 Daneel
3,737,304 A 6/1973 Blayden et al.
3,737,305 A 6/1973 Blayden et al.
3,743,263 A 7/1973 Szekely
3,743,500 A 7/1973 Foulard et al.
3,753,690 A 8/1973 Emley et al.
3,759,628 A 9/1973 Kempf
3,759,635 A 9/1973 Carter et al.
3,767,382 A 10/1973 Bruno et al.
3,776,660 A 12/1973 Anderson et al.
3,785,632 A 1/1974 Kraemer et al.
3,787,143 A 1/1974 Carbonnel et al.
3,799,522 A 3/1974 Brant et al.
3,799,523 A 3/1974 Seki
3,807,708 A 4/1974 Jones
3,814,400 A 6/1974 Seki
3,824,028 A 7/1974 Zenkner et al.
3,824,042 A 7/1974 Barnes et al.
3,836,280 A 9/1974 Koch
3,839,019 A 10/1974 Bruno et al.
3,844,972 A 10/1974 Tully, Jr. et al.
3,871,872 A 3/1975 Downing et al.
3,873,073 A 3/1975 Baum et al.
3,873,305 A 3/1975 Claxton et al.
3,881,039 A 4/1975 Baldieri et al.
3,886,992 A 6/1975 Maas et al.
3,915,594 A 10/1975 Nesseth
3,915,694 A 10/1975 Ando
3,935,003 A 1/1976 Steinke et al.
3,941,588 A 3/1976 Dremann
3,941,589 A 3/1976 Norman et al.
3,942,473 A 3/1976 Chodash
3,954,134 A 5/1976 Maas et al.
3,958,979 A 5/1976 Valdo
3,958,981 A 5/1976 Forberg et al.
3,961,778 A 6/1976 Carbonnel et al.
3,966,456 A 6/1976 Ellenbaum et al.
3,967,286 A 6/1976 Andersson et al.
3,972,709 A 8/1976 Chin et al.
3,973,871 A 8/1976 Hance
3,984,234 A 10/1976 Claxton et al.
3,985,000 A 10/1976 Hartz
3,997,336 A 12/1976 van Linden et al.
4,003,560 A 1/1977 Carbonnel
4,008,884 A 2/1977 Fitzpatrick et al.
4,018,598 A 4/1977 Markus
4,043,146 A 8/1977 Stegherr et al.
4,052,199 A 10/1977 Mangalick
4,055,390 A 10/1977 Young
4,063,849 A 12/1977 Modianos
4,068,965 A 1/1978 Lichti
4,073,606 A 2/1978 Eller
4,091,970 A 5/1978 Komiyama et al.
4,119,141 A 10/1978 Thut et al.
4,125,146 A 11/1978 Muller
4,126,360 A 11/1978 Miller et al.
4,128,415 A 12/1978 van Linden et al.
4,147,474 A 4/1979 Heimdal et al.
4,169,584 A 10/1979 Mangalick
4,191,486 A 3/1980 Pelton
4,213,742 A 7/1980 Henshaw
4,242,039 A 12/1980 Villard et al.
4,244,423 A 1/1981 Thut et al.
4,286,985 A 9/1981 van Linden et al.
4,305,214 A 12/1981 Hurst
4,322,245 A 3/1982 Claxton
4,338,062 A 7/1982 Neal
4,347,041 A 8/1982 Cooper
4,351,514 A 9/1982 Koch
4,355,789 A 10/1982 Dolzhenkov et al.
4,356,940 A 11/1982 Ansorge
4,360,314 A 11/1982 Pennell
4,370,096 A 1/1983 Church
4,372,541 A 2/1983 Bocourt et al.
4,375,937 A 3/1983 Cooper
4,389,159 A 6/1983 Sarvanne
4,392,888 A 7/1983 Eckert et al.
4,410,299 A 10/1983 Shimoyama
4,419,049 A 12/1983 Gerboth et al.
4,456,424 A 6/1984 Araoka
4,470,846 A 9/1984 Dube
4,474,315 A 10/1984 Gilbert et al.
4,496,393 A 1/1985 Lustenberger
4,504,392 A 3/1985 Groteke
4,509,979 A 4/1985 Bauer
4,537,624 A 8/1985 Tenhover et al.
4,537,625 A 8/1985 Tenhover et al.
4,545,887 A 10/1985 Amesen
4,556,419 A 12/1985 Otsuka et al.
4,557,766 A 12/1985 Tenhover et al.
4,586,845 A 5/1986 Morris
4,592,700 A 6/1986 Toguchi et al.
4,594,052 A 6/1986 Niskanen
4,596,510 A 6/1986 Ameth et al.
4,598,899 A 7/1986 Cooper
4,600,222 A 7/1986 Appling
4,607,825 A 8/1986 Briolle et al.
4,609,442 A 9/1986 Tenhover et al.
4,611,790 A 9/1986 Otsuka et al.
4,617,232 A 10/1986 Chandler et al.
4,634,105 A 1/1987 Withers et al.
4,640,666 A 2/1987 Sodergard
4,655,610 A 4/1987 Al-Jaroudi
4,669,953 A 6/1987 Gschwender
4,673,434 A 6/1987 Withers et al.
4,682,585 A 7/1987 Hiltebrandt
4,684,281 A 8/1987 Patterson
4,685,822 A 8/1987 Pelton
4,696,703 A 9/1987 Henderson et al.
4,701,226 A 10/1987 Henderson et al.
4,702,768 A 10/1987 Areauz et al.
4,714,371 A 12/1987 Cuse
4,717,540 A 1/1988 McRae et al.
4,739,974 A 4/1988 Mordue
4,741,664 A 5/1988 Olmstead
4,743,428 A 5/1988 McRae et al.
4,747,583 A 5/1988 Gordon et al.
4,767,230 A 8/1988 Leas, Jr.
4,770,701 A 9/1988 Henderson et al.
4,786,230 A 11/1988 Thut
4,802,656 A 2/1989 Hudault et al.
4,804,168 A 2/1989 Otsuka et al.
4,810,314 A 3/1989 Henderson et al.
4,822,473 A 4/1989 Arnesen
4,834,573 A 5/1989 Asano et al.
4,842,227 A 6/1989 Harrington et al.
4,844,425 A 7/1989 Piras et al.
4,851,296 A 7/1989 Tenhover et al.
4,859,413 A 8/1989 Harris et al.
4,860,819 A 8/1989 Moscoe et al.
4,867,638 A 9/1989 Handtmann et al.
4,884,786 A 12/1989 Gillespie
4,898,367 A 2/1990 Cooper
4,908,060 A 3/1990 Duenkelmann
4,911,726 A 3/1990 Warkentin
4,923,770 A 5/1990 Grasselli et al.
4,930,986 A 6/1990 Cooper
4,931,091 A 6/1990 Waite et al.
4,940,214 A 7/1990 Gillespie
4,940,384 A 7/1990 Amra et al.
4,954,167 A 9/1990 Cooper
4,967,827 A 11/1990 Campbell
4,973,433 A 11/1990 Gilbert et al.

(56) References Cited

U.S. PATENT DOCUMENTS 4,986,736 A 1/1991 Kajiwara et al.
5,015,518 A 5/1991 Sasaki et al.
5,025,198 A 6/1991 Mordue et al.
5,028,211 A 7/1991 Mordue et al.
5,029,821 A 7/1991 Bar-on et al.
5,058,654 A 10/1991 Simmons
5,078,572 A 1/1992 Amra et al.
5,080,715 A 1/1992 Provencher et al.
5,083,753 A 1/1992 Soofi
5,088,893 A 2/1992 Gilbert et al.
5,092,821 A 3/1992 Gilbert et al.
5,098,134 A 3/1992 Monckton
5,099,554 A 3/1992 Cooper
5,114,312 A 5/1992 Stanislao
5,126,047 A 6/1992 Martin et al.
5,131,632 A 7/1992 Olson
5,135,202 A 8/1992 Yamashita et al.
5,143,357 A 9/1992 Gilbert et al.
5,145,322 A 9/1992 Senior, Jr. et al.
5,152,631 A 10/1992 Bauer
5,154,652 A 10/1992 Ecklesdafer
5,158,440 A 10/1992 Cooper et al.
5,162,858 A 11/1992 Shoji et al.
5,165,858 A 11/1992 Gilbert et al.
5,177,304 A 1/1993 Nagel
5,191,154 A 3/1993 Nagel
5,192,193 A 3/1993 Cooper et al.
5,202,100 A 4/1993 Nagel et al.
5,203,681 A 4/1993 Cooper
5,209,641 A 5/1993 Hoghind et al.
5,215,448 A 6/1993 Cooper
5,268,020 A 12/1993 Claxton
5,286,163 A 2/1994 Amra et al.
5,298,233 A 3/1994 Nagel
5,301,620 A 4/1994 Nagel et al.
5,303,903 A 4/1994 Butler et al.
5,308,045 A 5/1994 Cooper
5,310,412 A 5/1994 Gilbert et al.
5,318,360 A 6/1994 Langer et al.
5,322,547 A 6/1994 Nagel et al.
5,324,341 A 6/1994 Nagel et al.
5,330,328 A 7/1994 Cooper
5,354,940 A 10/1994 Nagel
5,358,549 A 10/1994 Nagel et al.
5,358,697 A 10/1994 Nagel
5,364,078 A 11/1994 Pelton
5,369,063 A 11/1994 Gee et al.
5,388,633 A 2/1995 Mercer, II et al.
5,395,405 A 3/1995 Nagel et al.
5,399,074 A 3/1995 Nose et al.
5,407,294 A 4/1995 Giannini
5,411,240 A 5/1995 Rapp et al.
5,425,410 A 6/1995 Reynolds
5,431,551 A 7/1995 Aquino et al.
5,435,982 A 7/1995 Wilkinson
5,436,210 A 7/1995 Wilkinson et al.
5,443,572 A 8/1995 Wilkinson et al.
5,454,423 A 10/1995 Tsuchida et al.
5,468,280 A 11/1995 Areaux
5,470,201 A 11/1995 Gilbert et al.
5,484,265 A 1/1996 Horvath et al.
5,489,734 A 2/1996 Nagel et al.
5,491,279 A 2/1996 Robert et al.
5,494,382 A 2/1996 Kloppers
5,495,746 A 3/1996 Sigworth
5,505,143 A 4/1996 Nagel
5,505,435 A 4/1996 Laszlo
5,509,791 A 4/1996 Turner
5,511,766 A 4/1996 Vassilicos
5,520,422 A 5/1996 Friedrich
5,537,940 A 7/1996 Nagel et al.
5,543,558 A 8/1996 Nagel et al.
5,555,822 A 9/1996 Loewen et al.
5,558,501 A 9/1996 Wang et al.
5,558,505 A 9/1996 Mordue et al.
5,571,486 A 11/1996 Robert et al.
5,585,532 A 12/1996 Nagel
5,586,863 A 12/1996 Gilbert et al.
5,591,243 A 1/1997 Colussi et al.
5,597,289 A 1/1997 Thut
5,613,245 A 3/1997 Robert
5,616,167 A 4/1997 Eckert
5,622,481 A 4/1997 Thut
5,629,464 A 5/1997 Bach et al.
5,634,770 A 6/1997 Gilbert et al.
5,640,706 A 6/1997 Nagel et al.
5,640,707 A 6/1997 Nagel et al.
5,640,709 A 6/1997 Nagel et al.
5,655,849 A 8/1997 McEwen et al.
5,660,614 A 8/1997 Waite et al.
5,662,725 A 9/1997 Cooper
5,676,520 A 10/1997 Thut
5,678,244 A 10/1997 Shaw et al.
5,678,807 A 10/1997 Cooper
5,679,132 A 10/1997 Rauenzahn et al.
5,685,701 A 11/1997 Chandler et al.
5,690,888 A 11/1997 Robert
5,695,732 A 12/1997 Sparks et al.
5,716,195 A 2/1998 Thut
5,717,149 A 2/1998 Nagel et al.
5,718,416 A 2/1998 Flisakowski et al.
5,735,668 A 4/1998 Klein
5,735,935 A 4/1998 Areaux
5,741,422 A 4/1998 Eichenmiller et al.
5,744,093 A 4/1998 Davis
5,744,117 A 4/1998 Wilkinson et al.
5,745,861 A 4/1998 Bell et al.
5,755,847 A 5/1998 Quayle
5,758,712 A 6/1998 Pederson
5,772,324 A 6/1998 Falk
5,776,420 A 7/1998 Nagel
5,785,494 A 7/1998 Vild et al.
5,842,832 A 12/1998 Thut
5,846,481 A 12/1998 Tilak
5,858,059 A 1/1999 Abramovich et al.
5,863,314 A 1/1999 Morando
5,866,095 A 2/1999 McGeever et al.
5,875,385 A 2/1999 Stephenson et al.
5,935,528 A 8/1999 Stephenson et al.
5,944,496 A 8/1999 Cooper
5,947,705 A 9/1999 Mordue et al.
5,948,352 A 9/1999 Jagt et al.
5,951,243 A 9/1999 Cooper
5,961,285 A 10/1999 Meneice et al.
5,963,580 A 10/1999 Eckert
5,992,230 A 11/1999 Scarpa et al.
5,993,726 A 11/1999 Huang
5,993,728 A 11/1999 Vild
6,007,313 A 12/1999 Sigel
6,019,576 A 2/2000 Thut
6,027,685 A 2/2000 Cooper
6,036,745 A 3/2000 Gilbert et al.
6,074,455 A 6/2000 van Linden et al.
6,082,965 A 7/2000 Morando
6,093,000 A 7/2000 Cooper
6,096,109 A 8/2000 Nagel et al.
6,113,154 A 9/2000 Thut
6,123,523 A 9/2000 Cooper
6,152,691 A 11/2000 Thut
6,168,753 B1 1/2001 Morando
6,187,096 B1 2/2001 Thut
6,199,836 B1 3/2001 Rexford et al.
6,217,823 B1 4/2001 Vild et al.
6,231,639 B1 5/2001 Eichenmiller
6,250,881 B1 6/2001 Mordue et al.
6,254,340 B1 7/2001 Vild et al.
6,270,717 B1 8/2001 Tremblay et al.
6,280,157 B1 8/2001 Cooper
6,293,759 B1 9/2001 Thut
6,303,074 B1 10/2001 Cooper
6,345,964 B1 2/2002 Cooper
6,354,796 B1 3/2002 Morando
6,358,467 B1 3/2002 Mordue
6,364,930 B1 4/2002 Kos

(56) References Cited

U.S. PATENT DOCUMENTS 6,371,723 B1 4/2002 Grant et al.
6,398,525 B1 6/2002 Cooper
6,439,860 B1 8/2002 Greer
6,451,247 B1 9/2002 Mordue et al.
6,457,940 B1 10/2002 Lehman
6,457,950 B1 10/2002 Cooper et al.
6,464,458 B2 10/2002 Vild et al.
6,495,948 B1 12/2002 Garrett, III
6,497,559 B1 12/2002 Grant
6,500,228 B1 12/2002 Klingensmith et al.
6,503,292 B2 1/2003 Klingensmith et al.
6,524,066 B2 2/2003 Thut
6,533,535 B2 3/2003 Thut
6,551,060 B2 4/2003 Mordue et al.
6,562,286 B1 5/2003 Lehman
6,656,415 B2 12/2003 Kos
6,679,936 B2 1/2004 Quackenbush
6,689,310 B1 2/2004 Cooper
6,709,234 B2 3/2004 Gilbert et al.
6,723,276 B1 4/2004 Cooper
6,805,834 B2 10/2004 Thut
6,843,640 B2 1/2005 Mordue et al.
6,848,497 B2 2/2005 Sale et al.
6,869,271 B2 3/2005 Gilbert et al.
6,869,564 B2 3/2005 Gilbert et al.
6,881,030 B2 4/2005 Thut
6,887,424 B2 5/2005 Ohno et al.
6,887,425 B2 5/2005 Mordue et al.
6,902,696 B2 6/2005 Klingensmith et al.
7,037,462 B2 5/2006 Klingensmith et al.
7,074,361 B2 7/2006 Carolla et al.
7,083,758 B2 8/2006 Tremblay
7,131,482 B2 11/2006 Vincent et al.
7,157,043 B2 1/2007 Neff
7,204,954 B2 4/2007 Mizuno
7,273,582 B2 9/2007 Mordue
7,279,128 B2 10/2007 Kennedy et al.
7,326,028 B2 2/2008 Morando
7,402,276 B2 7/2008 Cooper
7,470,392 B2 12/2008 Cooper
7,476,357 B2 1/2009 Thut
7,481,966 B2 1/2009 Mizuno
7,497,988 B2 3/2009 Thut
7,507,365 B2 3/2009 Thut
7,507,367 B2 3/2009 Cooper
7,543,605 B1 6/2009 Morando
7,731,891 B2 6/2010 Cooper
7,771,171 B2 8/2010 Mohr
7,841,379 B1 11/2010 Evans
7,896,617 B1 3/2011 Morando
7,906,068 B2 3/2011 Cooper
8,075,837 B2 12/2011 Cooper
8,110,141 B2 2/2012 Cooper
8,137,023 B2 3/2012 Greer
8,142,145 B2 3/2012 Thut
8,178,037 B2 5/2012 Cooper
8,328,540 B2 12/2012 Wang
8,333,921 B2 12/2012 Thut
8,361,379 B2 1/2013 Cooper
8,366,993 B2 2/2013 Cooper
8,409,495 B2 4/2013 Cooper
8,440,135 B2 5/2013 Cooper
8,444,911 B2 5/2013 Cooper
8,449,814 B2 5/2013 Cooper
8,475,594 B2 7/2013 Bright et al.
8,475,708 B2 7/2013 Cooper
8,480,950 B2 7/2013 Jetten et al.
8,501,084 B2 8/2013 Cooper
8,524,146 B2 9/2013 Cooper
8,529,828 B2 9/2013 Cooper
8,535,603 B2 9/2013 Cooper
8,580,218 B2 11/2013 Turenne et al.
8,613,884 B2 12/2013 Cooper
8,714,914 B2 5/2014 Cooper
8,753,563 B2 6/2014 Cooper
8,840,359 B2 9/2014 Vick et al.
8,899,932 B2 12/2014 Tetkoskie et al.
8,915,830 B2 12/2014 March et al.
8,920,680 B2 12/2014 Mao
9,011,761 B2 4/2015 Cooper
9,017,597 B2 4/2015 Cooper
9,034,244 B2 5/2015 Cooper
9,057,376 B2 6/2015 Thut
9,057,377 B1 6/2015 Thut
9,074,601 B1 7/2015 Thut
9,080,577 B2 7/2015 Cooper
9,108,224 B2 8/2015 Schererz et al.
9,108,244 B2 8/2015 Cooper
9,156,087 B2 10/2015 Cooper
9,193,532 B2 11/2015 March et al.
9,205,490 B2 12/2015 Cooper
9,234,520 B2 1/2016 Morando
9,273,376 B2 3/2016 Lutes et al.
9,328,615 B2 5/2016 Cooper
9,377,028 B2 6/2016 Cooper
9,382,599 B2 7/2016 Cooper
9,383,140 B2 7/2016 Cooper
9,409,232 B2 8/2016 Cooper
9,410,744 B2 8/2016 Cooper
9,422,942 B2 8/2016 Cooper
9,435,343 B2 9/2016 Cooper
9,464,636 B2 10/2016 Cooper
9,470,239 B2 10/2016 Cooper
9,476,644 B2 10/2016 Howitt et al.
9,481,035 B2 11/2016 Cooper
9,481,918 B2 11/2016 Vild et al.
9,482,469 B2 11/2016 Cooper
9,494,366 B1 11/2016 Thut
9,506,129 B2 11/2016 Cooper
9,506,346 B2 11/2016 Bright et al.
9,566,645 B2 2/2017 Cooper
9,581,388 B2 2/2017 Cooper
9,587,883 B2 3/2017 Cooper
9,657,578 B2 5/2017 Cooper
9,855,600 B2 1/2018 Cooper
9,862,026 B2 1/2018 Cooper
9,903,383 B2 2/2018 Cooper
9,909,808 B2 3/2018 Cooper
9,925,587 B2 3/2018 Cooper
9,951,777 B2 4/2018 Morando et al.
9,970,442 B2 5/2018 Tipton
9,982,945 B2 5/2018 Cooper
10,052,688 B2 8/2018 Cooper
10,072,897 B2 9/2018 Cooper
10,126,058 B2 11/2018 Cooper
10,126,059 B2 11/2018 Cooper
10,138,892 B2 11/2018 Cooper
10,195,664 B2 2/2019 Cooper et al.
10,267,314 B2 4/2019 Cooper
10,274,256 B2 4/2019 Cooper
10,302,361 B2 5/2019 Cooper
10,307,821 B2 6/2019 Cooper
10,309,725 B2 6/2019 Cooper
10,322,451 B2 6/2019 Cooper
10,345,045 B2 7/2019 Cooper
10,352,620 B2 7/2019 Cooper
10,428,821 B2 10/2019 Cooper
10,458,708 B2 10/2019 Cooper
10,465,688 B2 11/2019 Cooper
10,562,097 B2 2/2020 Cooper
10,570,745 B2 2/2020 Cooper
10,641,270 B2 5/2020 Cooper
10,641,279 B2 5/2020 Cooper
10,675,679 B2 6/2020 Cooper
11,020,798 B2 6/2021 Cooper
11,098,719 B2 8/2021 Cooper
11,098,720 B2 8/2021 Cooper
11,103,920 B2 8/2021 Cooper
11,130,173 B2 9/2021 Cooper
11,149,747 B2 10/2021 Cooper
11,167,345 B2 11/2021 Cooper
11,185,916 B2 11/2021 Cooper
11,358,216 B2 6/2022 Cooper
11,358,217 B2 * 6/2022 Cooper ..... F27D 27/005

(56) References Cited

U.S. PATENT DOCUMENTS

| | | | |
|---|---|---|---|
| 11,391,293 | B2 | 7/2022 | Cooper |
| 11,519,414 | B2 | 12/2022 | Cooper |
| 2001/0000465 | A1 | 4/2001 | Thut |
| 2002/0089099 | A1 | 7/2002 | Denning |
| 2002/0146313 | A1 | 10/2002 | Thut |
| 2002/0185794 | A1 | 12/2002 | Vincent |
| 2003/0047850 | A1 | 3/2003 | Areaux |
| 2003/0075844 | A1 | 4/2003 | Mordue et al. |
| 2003/0082052 | A1 | 5/2003 | Gilbert et al. |
| 2003/0151176 | A1 | 8/2003 | Ohno |
| 2003/0201583 | A1 | 10/2003 | Klingensmith |
| 2004/0050525 | A1 | 3/2004 | Kennedy et al. |
| 2004/0076533 | A1 | 4/2004 | Cooper |
| 2004/0096330 | A1 | 5/2004 | Gilbert |
| 2004/0115079 | A1 | 6/2004 | Cooper |
| 2004/0245684 | A1 | 12/2004 | Kojo |
| 2004/0262825 | A1 | 12/2004 | Cooper |
| 2005/0013713 | A1 | 1/2005 | Cooper |
| 2005/0013714 | A1 | 1/2005 | Cooper |
| 2005/0013715 | A1 | 1/2005 | Cooper |
| 2005/0053499 | A1 | 3/2005 | Cooper |
| 2005/0077730 | A1 | 4/2005 | Thut |
| 2005/0116398 | A1 | 6/2005 | Tremblay |
| 2006/0180963 | A1 | 8/2006 | Thut |
| 2007/0253807 | A1 | 11/2007 | Cooper |
| 2008/0163999 | A1 | 7/2008 | Hymas et al. |
| 2008/0202644 | A1 | 8/2008 | Grassi |
| 2008/0211147 | A1 | 9/2008 | Cooper |
| 2008/0213111 | A1 | 9/2008 | Cooper |
| 2008/0230966 | A1 | 9/2008 | Cooper |
| 2008/0253905 | A1 | 10/2008 | Morando et al. |
| 2008/0304970 | A1 | 12/2008 | Cooper |
| 2008/0314548 | A1 | 12/2008 | Cooper |
| 2009/0054167 | A1 | 2/2009 | Cooper |
| 2009/0269191 | A1 | 10/2009 | Cooper |
| 2010/0104415 | A1 | 4/2010 | Morando |
| 2010/0200354 | A1 | 8/2010 | Yagi et al. |
| 2011/0133374 | A1 | 6/2011 | Cooper |
| 2011/0140318 | A1 | 6/2011 | Reeves et al. |
| 2011/0140319 | A1 | 6/2011 | Cooper |
| 2011/0142603 | A1 | 6/2011 | Cooper |
| 2011/0142606 | A1 | 6/2011 | Cooper |
| 2011/0148012 | A1 | 6/2011 | Cooper |
| 2011/0163486 | A1 | 7/2011 | Cooper |
| 2011/0210232 | A1 | 9/2011 | Cooper |
| 2011/0220771 | A1 | 9/2011 | Cooper |
| 2011/0227338 | A1 | 9/2011 | Pollack |
| 2011/0303706 | A1 | 12/2011 | Cooper |
| 2012/0003099 | A1 | 1/2012 | Tetkoskie |
| 2012/0163959 | A1 | 6/2012 | Morando |
| 2013/0105102 | A1 | 5/2013 | Cooper |
| 2013/0142625 | A1 | 6/2013 | Cooper |
| 2013/0214014 | A1 | 8/2013 | Cooper |
| 2013/0224038 | A1 | 8/2013 | Tetkoskie et al. |
| 2013/0292426 | A1 | 11/2013 | Cooper |
| 2013/0292427 | A1 | 11/2013 | Cooper |
| 2013/0299524 | A1 | 11/2013 | Cooper |
| 2013/0299525 | A1 | 11/2013 | Cooper |
| 2013/0306687 | A1 | 11/2013 | Cooper |
| 2013/0343904 | A1 | 12/2013 | Cooper |
| 2014/0008849 | A1 | 1/2014 | Cooper |
| 2014/0041252 | A1 | 2/2014 | Vild et al. |
| 2014/0044520 | A1 | 2/2014 | Tipton |
| 2014/0083253 | A1 | 3/2014 | Lutes et al. |
| 2014/0210144 | A1 | 7/2014 | Torres et al. |
| 2014/0232048 | A1 | 8/2014 | Howitt et al. |
| 2014/0252697 | A1 | 9/2014 | Rauch |
| 2014/0252701 | A1 | 9/2014 | Cooper |
| 2014/0261800 | A1 | 9/2014 | Cooper |
| 2014/0263482 | A1 | 9/2014 | Cooper |
| 2014/0265068 | A1 | 9/2014 | Cooper |
| 2014/0271219 | A1 | 9/2014 | Cooper |
| 2014/0363309 | A1 | 12/2014 | Henderson et al. |
| 2015/0069679 | A1 | 3/2015 | Henderson et al. |
| 2015/0184311 | A1 | 7/2015 | Turenne |
| 2015/0192364 | A1 | 7/2015 | Cooper |
| 2015/0217369 | A1 | 8/2015 | Cooper |
| 2015/0219111 | A1 | 8/2015 | Cooper |
| 2015/0219112 | A1 | 8/2015 | Cooper |
| 2015/0219113 | A1 | 8/2015 | Cooper |
| 2015/0219114 | A1 | 8/2015 | Cooper |
| 2015/0224574 | A1 | 8/2015 | Cooper |
| 2015/0252807 | A1 | 9/2015 | Cooper |
| 2015/0285557 | A1 | 10/2015 | Cooper |
| 2015/0285558 | A1 | 10/2015 | Cooper |
| 2015/0323256 | A1 | 11/2015 | Cooper |
| 2015/0328682 | A1 | 11/2015 | Cooper |
| 2015/0328683 | A1 | 11/2015 | Cooper |
| 2016/0031007 | A1 | 2/2016 | Cooper |
| 2016/0040265 | A1 | 2/2016 | Cooper |
| 2016/0047602 | A1 | 2/2016 | Cooper |
| 2016/0053762 | A1 | 2/2016 | Cooper |
| 2016/0053814 | A1 | 2/2016 | Cooper |
| 2016/0082507 | A1 | 3/2016 | Cooper |
| 2016/0089718 | A1 | 3/2016 | Cooper |
| 2016/0091251 | A1 | 3/2016 | Cooper |
| 2016/0116216 | A1 | 4/2016 | Schlicht et al. |
| 2016/0221855 | A1 | 8/2016 | Retorick et al. |
| 2016/0250686 | A1 | 9/2016 | Cooper |
| 2016/0265535 | A1 | 9/2016 | Cooper |
| 2016/0305711 | A1 | 10/2016 | Cooper |
| 2016/0320129 | A1 | 11/2016 | Cooper |
| 2016/0320130 | A1 | 11/2016 | Cooper |
| 2016/0320131 | A1 | 11/2016 | Cooper |
| 2016/0346836 | A1 | 12/2016 | Henderson et al. |
| 2016/0348973 | A1 | 12/2016 | Cooper |
| 2016/0348974 | A1 | 12/2016 | Cooper |
| 2016/0348975 | A1 | 12/2016 | Cooper |
| 2017/0037852 | A1 | 2/2017 | Bright et al. |
| 2017/0038146 | A1 | 2/2017 | Cooper |
| 2017/0045298 | A1 | 2/2017 | Cooper |
| 2017/0056973 | A1 | 3/2017 | Tremblay et al. |
| 2017/0082368 | A1 | 3/2017 | Cooper |
| 2017/0106435 | A1 | 4/2017 | Vincent |
| 2017/0106441 | A1 | 4/2017 | Vincent |
| 2017/0130298 | A1* | 5/2017 | Teranishi ..... C22B 7/003 |
| 2017/0167793 | A1 | 6/2017 | Cooper et al. |
| 2017/0198721 | A1 | 7/2017 | Cooper |
| 2017/0219289 | A1 | 8/2017 | Williams et al. |
| 2017/0241713 | A1 | 8/2017 | Henderson et al. |
| 2017/0246681 | A1 | 8/2017 | Tipton et al. |
| 2017/0276430 | A1 | 9/2017 | Cooper |
| 2018/0058465 | A1 | 3/2018 | Cooper |
| 2018/0111189 | A1 | 4/2018 | Cooper |
| 2018/0178281 | A1 | 6/2018 | Cooper |
| 2018/0195513 | A1 | 7/2018 | Cooper |
| 2018/0311726 | A1 | 11/2018 | Cooper |
| 2019/0032675 | A1 | 1/2019 | Cooper |
| 2019/0270134 | A1 | 9/2019 | Cooper |
| 2019/0293089 | A1 | 9/2019 | Cooper |
| 2019/0351481 | A1 | 11/2019 | Tetkoskie |
| 2019/0360491 | A1 | 11/2019 | Cooper |
| 2019/0360492 | A1 | 11/2019 | Cooper |
| 2019/0368494 | A1 | 12/2019 | Cooper |
| 2020/0130050 | A1 | 4/2020 | Cooper |
| 2020/0130051 | A1 | 4/2020 | Cooper |
| 2020/0130052 | A1 | 4/2020 | Cooper |
| 2020/0130053 | A1 | 4/2020 | Cooper |
| 2020/0130054 | A1 | 4/2020 | Cooper |
| 2020/0182247 | A1 | 6/2020 | Cooper |
| 2020/0182248 | A1 | 6/2020 | Cooper |
| 2020/0256350 | A1 | 8/2020 | Cooper |
| 2020/0360987 | A1 | 11/2020 | Cooper |
| 2020/0360988 | A1 | 11/2020 | Fontana |
| 2020/0360989 | A1 | 11/2020 | Cooper |
| 2020/0360990 | A1 | 11/2020 | Cooper |
| 2020/0362865 | A1* | 11/2020 | Cooper ..... B22D 41/00 |
| 2021/0199115 | A1 | 7/2021 | Cooper |
| 2021/0254622 | A1 | 8/2021 | Cooper |
| 2022/0080498 | A1 | 3/2022 | Cooper |
| 2022/0193764 | A1* | 6/2022 | Cooper ..... F04D 7/065 |
| 2022/0213895 | A1 | 7/2022 | Cooper |

(56) References Cited

U.S. PATENT DOCUMENTS

| | | | | |
|---|---|---|---|---|
| 2022/0234099 | A1* | 7/2022 | Cooper | B22D 41/00 |
| 2022/0381246 | A1 | 12/2022 | Cooper | |
| 2023/0001474 | A1 | 1/2023 | Cooper | |

FOREIGN PATENT DOCUMENTS

| | | | |
|---|---|---|---|
| CA | 2244251 | | 6/1998 |
| CA | 2305865 | | 2/2000 |
| CA | 2176475 | | 7/2005 |
| CA | 2924572 | | 4/2015 |
| CH | 392268 | | 9/1965 |
| CN | 102943761 | | 2/2013 |
| CN | 103511331 | | 1/2014 |
| DE | 1800446 | | 12/1969 |
| DE | 19541093 | | 5/1997 |
| DE | 19614350 | | 10/1997 |
| DE | 102006051814 | | 7/2008 |
| EP | 168250 | | 1/1986 |
| EP | 665378 | | 8/1995 |
| EP | 1019635 | | 6/2006 |
| GB | 543607 | | 3/1942 |
| GB | 942648 | | 11/1963 |
| GB | 1185314 | | 3/1970 |
| GB | 1565911 | A | 4/1980 |
| GB | 1575991 | | 10/1980 |
| GB | 2122260 | | 11/1984 |
| GB | 2193257 | | 2/1988 |
| GB | 2217784 | | 3/1989 |
| GB | 2289919 | | 12/1995 |
| JP | 58048796 | | 3/1983 |
| JP | 63104773 | | 5/1988 |
| JP | 11-270799 | | 10/1999 |
| JP | 5112837 | | 1/2013 |
| MX | 227385 | | 4/2005 |
| NO | 90756 | | 1/1959 |
| RU | 416401 | | 2/1974 |
| RU | 773312 | | 10/1980 |
| WO | 199808990 | | 3/1998 |
| WO | 199825031 | | 6/1998 |
| WO | 200009889 | | 2/2000 |
| WO | 2002012147 | | 2/2002 |
| WO | 2004029307 | | 4/2004 |
| WO | 2010147932 | | 12/2010 |
| WO | 2014055082 | | 4/2014 |
| WO | 2014150503 | | 9/2014 |
| WO | 2014185971 | | 11/2014 |

OTHER PUBLICATIONS

Document No. 504217: Excerpts from "Pyrotek Inc.'s Motion for Summary Judgment of Invalidity and Unenforceability of U.S. Pat. No. 7,402,276," Oct. 2, 2009.

Document No. 505026: Excerpts from "MMEI's Response to Pyrotek's Motion for Summary Judgment of Invalidity or Enforceability of U.S. Pat. No. 7,402,276," Oct. 9, 2009.

Document No. 507689: Excerpts from "MMEI's Pre-Hearing Brief and Supplemental Motion for Summary Judgment of Infringement of Claims 3, 4, 15, 17-20, 26, 28 and 29 of the '074 Patent and Motion for Reconsideration of the Validity of Claims 7-9 of the '276 Patent," Nov. 4, 2009.

Document No. 517158: Excerpts from "Reasoned Award," Feb. 19, 2010.

Document No. 525055: Excerpts from "Molten Metal Equipment Innovations, Inc.'s Reply Brief in Support of Application to Confirm Arbitration Award and Opposition to Motion to Vacate," May 12, 2010.

USPTO; Notice of Reissue Examination Certificate dated Aug. 27, 2001 in U.S. Appl. No. 90/005,910.

* cited by examiner

MELTING METAL ON A RAISED SURFACE

CROSS REFERENCE TO RELATED APPLICATIONS

This application is a continuation of, and claims priority to U.S. patent application Ser. No. 16/877,219 (now U.S. Pat. No. 11,358,217), filed May 18, 2020 and entitled "METHOD FOR MELTING SOLID METAL" which claims priority to U.S. Provisional Patent Application Ser. No. 62/849,787 filed May 17, 2019 and entitled MOLTEN METAL PUMPS, COMPONENTS, SYSTEMS AND METHODS, and U.S. Provisional Patent Application Ser. No. 62/852,846 filed May 24, 2019 and entitled SMART MOLTEN METAL PUMP. Each of the foregoing applications are incorporated by reference herein in their entirety for all purposes.

BACKGROUND OF THE INVENTION

As used herein, the term "molten metal" means any metal or combination of metals in liquid form, such as aluminum, copper, iron, zinc and alloys thereof. The term "gas" means any gas or combination of gases, including argon, nitrogen, chlorine, fluorine, Freon, and helium, which are released into molten metal.

Known molten-metal pumps include a pump base (also called a housing or casing), one or more inlets (an inlet being an opening in the housing to allow molten metal to enter a pump chamber), a pump chamber of any suitable configuration, which is an open area formed within the housing, and a discharge, which is a channel or conduit of any structure or type communicating with the pump chamber (in an axial pump the chamber and discharge may be the same structure or different areas of the same structure) leading from the pump chamber to an outlet, which is an opening formed in the exterior of the housing through which molten metal exits the casing. An impeller, also called a rotor, is mounted in the pump chamber and is connected to a drive system. The drive shaft is typically an impeller shaft connected to one end of a motor shaft, the other end of the drive shaft being connected to an impeller. Often, the impeller (or rotor) shaft is comprised of graphite and/or ceramic, the motor shaft is comprised of steel, and the two are connected by a coupling. As the motor turns the drive shaft, the drive shaft turns the impeller and the impeller pushes molten metal out of the pump chamber, through the discharge, out of the outlet and into the molten metal bath. Most molten metal pumps are gravity fed, wherein gravity forces molten metal through the inlet and into the pump chamber as the impeller pushes molten metal out of the pump chamber. Other molten metal pumps do not include a base or support posts and are sized to fit into a structure by which molten metal is pumped. Most pumps have a metal platform, or super structure, that is either supported by a plurality of support posts attached to the pump base, or unsupported if there is no base. The motor is positioned on the superstructure, if a superstructure is used.

This application incorporates by reference the portions of the following publications that are not inconsistent with this disclosure: U.S. Pat. No. 4,598,899, issued Jul. 8, 1986, to Paul V. Cooper, U.S. Pat. No. 5,203,681, issued Apr. 20, 1993, to Paul V. Cooper, U.S. Pat. No. 5,308,045, issued May 3, 1994, by Paul V. Cooper, U.S. Pat. No. 5,662,725, issued Sep. 2, 1997, by Paul V. Cooper, U.S. Pat. No. 5,678,807, issued Oct. 21, 1997, by Paul V. Cooper, U.S. Pat. No. 6,027,685, issued Feb. 22, 2000, by Paul V. Cooper, U.S. Pat. No. 6,124,523, issued Sep. 26, 2000, by Paul V. Cooper, U.S. Pat. No. 6,303,074, issued Oct. 16, 2001, by Paul V. Cooper, U.S. Pat. No. 6,689,310, issued Feb. 10, 2004, by Paul V. Cooper, U.S. Pat. No. 6,723,276, issued Apr. 20, 2004, by Paul V. Cooper, U.S. Pat. No. 7,402,276, issued Jul. 22, 2008, by Paul V. Cooper, U.S. Pat. No. 7,507,367, issued Mar. 24, 2009, by Paul V. Cooper, U.S. Pat. No. 7,906,068, issued Mar. 15, 2011, by Paul V. Cooper, U.S. Pat. No. 8,075,837, issued Dec. 13, 2011, by Paul V. Cooper, U.S. Pat. No. 8,110,141, issued Feb. 7, 2012, by Paul V. Cooper, U.S. Pat. No. 8,178,037, issued May 15, 2012, by Paul V. Cooper, U.S. Pat. No. 8,361,379, issued Jan. 29, 2013, by Paul V. Cooper, U.S. Pat. No. 8,366,993, issued Feb. 5, 2013, by Paul V. Cooper, U.S. Pat. No. 8,409,495, issued Apr. 2, 2013, by Paul V. Cooper, U.S. Pat. No. 8,440,135, issued May 15, 2013, by Paul V. Cooper, U.S. Pat. No. 8,444,911, issued May 21, 2013, by Paul V. Cooper, U.S. Pat. No. 8,475,708, issued Jul. 2, 2013, by Paul V. Cooper, U.S. patent application Ser. No. 12/895,796, filed Sep. 30, 2010, by Paul V. Cooper, U.S. patent application Ser. No. 12/877,988, filed Sep. 8, 2010, by Paul V. Cooper, U.S. patent application Ser. No. 12/853,238, filed Aug. 9, 2010, by Paul V. Cooper, U.S. patent application Ser. No. 12/880,027, filed Sep. 10, 2010, by Paul V. Cooper, U.S. patent application Ser. No. 13/752,312, filed Jan. 28, 2013, by Paul V. Cooper, U.S. patent application Ser. No. 13/756,468, filed Jan. 31, 2013, by Paul V. Cooper, U.S. patent application Ser. No. 13/791,889, filed Mar. 8, 2013, by Paul V. Cooper, U.S. patent application Ser. No. 13/791,952, filed Mar. 9, 2013, by Paul V. Cooper, U.S. patent application Ser. No. 13/841,594, filed Mar. 15, 2013, by Paul V. Cooper, and U.S. patent application Ser. No. 14/027,237, filed Sep. 15, 2013, by Paul V. Cooper, U.S. Pat. No. 8,535,603 entitled ROTARY DEGASSER AND ROTOR THEREFOR, U.S. Pat. No. 8,613,884 entitled LAUNDER TRANSFER INSERT AND SYSTEM, U.S. Pat. No. 8,714,914 entitled MOLTEN METAL PUMP FILTER, U.S. Pat. No. 8,753,563 entitled SYSTEM AND METHOD FOR DEGASSING MOLTEN METAL, U.S. Pat. No. 9,011,761 entitled LADLE WITH TRANSFER CONDUIT, U.S. Pat. No. 9,017,597 entitled TRANSFERRING MOLTEN METAL USING NON-GRAVITY ASSIST LAUNDER, U.S. Pat. No. 9,034,244 entitled GAS-TRANSFER FOOT, U.S. Pat. No. 9,080,577 entitled SHAFT AND POST TENSIONING DEVICE, U.S. Pat. No. 9,108,244 entitled IMMERSION HEATHER FOR MOLTEN METAL, U.S. Pat. No. 9,156,087 entitled MOLTEN METAL TRANSFER SYSTEM AND ROTOR, U.S. Pat. No. 9,205,490 entitled TRANSFER WELL SYSTEM AND METHOD FOR MAKING SAME, U.S. Pat. No. 9,328,615 entitled ROTARY DEGASSERS AND COMPONENTS THEREFOR, U.S. Pat. No. 9,377,028 entitled TENSIONING DEVICE EXTENDING BEYOND COMPONENT, U.S. Pat. No. 9,382,599 entitled ROTARY DEGASSER AND ROTOR THEREFOR, U.S. Pat. No. 9,383,140 entitled TRANSFERRING MOLTEN METAL FROM ONE STRUCTURE TO ANOTHER, U.S. Pat. No. 9,409,232 entitled MOLTEN METAL TRANSFER VESSEL AND METHOD OF CONSTRUCTION, U.S. Pat. No. 9,410,744 entitled VESSEL TRANSFER INSERT AND SYSTEM, U.S. Pat. No. 9,422,942 entitled TENSION DEVICE WITH INTERNAL PASSAGE, U.S. Pat. No. 9,435,343 entitled GAS-TRANSFER FOOT, U.S. Pat. No. 9,464,636 entitled TENSION DEVICE GRAPHITE COMPONENT USED IN MOLTEN METAL, U.S. Pat. No. 9,470,239 THREADED TENSIONING DEVICE, U.S. Pat. No. 9,481,035 entitled IMMERSION HEATER FOR MOLTEN METAL, U.S. Pat. No. 9,482,469 entitled VESSEL TRANSFER INSERT AND SYSTEM, U.S. Pat. No. 9,506,129 entitled ROTARY DEGASSER AND ROTOR THEREFOR, U.S. Pat. No. 9,566,645 entitled MOLTEN METAL TRANSFER SYSTEM AND ROTOR, U.S. Pat. No. 9,581,388 entitled VESSEL TRANSFER INSERT AND SYSTEM, U.S. Pat. No. 9,587,883 entitled LADLE WITH TRANSFER CONDUIT, U.S. Pat. No. 9,643,247 entitled MOLTEN METAL TRANSFER AND DEGASSING SYSTEM, U.S. Pat. No. 9,657,578 entitled ROTARY DEGASSERS AND COMPONENTS THEREFOR, U.S. Pat. No. 9,855,600 entitled MOLTEN METAL TRANSFER SYSTEM AND ROTOR, U.S. Pat. No. 9,862,026 entitled METHOD OF FORMING TRANSFER WELL, U.S. Pat. No. 9,903,383 entitled MOLTEN METAL ROTOR WITH HARDENED TOP, U.S. Pat. No. 9,909,808 entitled SYSTEM AND METHOD FOR DEGASSING MOLTEN METAL, U.S. Pat. No. 9,925,587 entitled METHOD OF TRANSFERRING MOLTEN METAL FROM A VESSEL, entitled U.S. Pat. No. 9,982,945 MOLTEN METAL TRANSFER VESSEL AND METHOD OF CONSTRUCTION, U.S. Pat. No. 10,052,688 entitled TRANSFER PUMP LAUNDER SYSTEM, U.S. Pat. No. 10,072,891 entitled TRANSFERRING MOLTEN METAL USING NON-GRAVITY ASSIST LAUNDER, U.S. Pat. No. 10,126,058 entitled MOLTEN METAL TRANSFERRING VESSEL, U.S. Pat. No. 10,126,059 entitled CONTROLLED MOLTEN METAL FLOW FROM TRANSFER VESSEL, U.S. Pat. No. 10,138,892 entitled ROTOR AND ROTOR SHAFT FOR MOLTEN METAL, U.S. Pat. No. 10,195,664 entitled MULTI-STAGE IMPELLER FOR MOLTEN METAL, U.S. Pat. No. 10,267,314 entitled TENSIONED SUPPORT SHAFT AND OTHER MOLTEN METAL DEVICES, U.S. Pat. No. 10,274,256 entitled VESSEL TRANSFER SYSTEMS AND DEVICES, U.S. Pat. No. 10,302,361 entitled TRANSFER VESSEL FOR MOLTEN METAL PUMPING DEVICE, U.S. Pat. No. 10,309,725 entitled IMMERSION HEATER FOR MOLTEN METAL, U.S. Pat. No. 10,307,821 entitled TRANSFER PUMP LAUNDER SYSTEM, U.S. Pat. No. 10,322,451 entitled TRANSFER PUMP LAUNDER SYSTEM, U.S. Pat. No. 10,345,045 entitled VESSEL TRANSFER INSERT AND SYSTEM, U.S. Pat. No. 10,352,620 entitled TRANSFERRING MOLTEN METAL FROM ONE STRUCTURE TO ANOTHER, U.S. Pat. No. 10,428,821 entitled QUICK SUBMERGENCE MOLTEN METAL PUMP, U.S. Pat. No. 10,458,708 entitled TRANSFERRING MOLTEN METAL FROM ONE STRUCTURE TO ANOTHER, U.S. Pat. No. 10,465,688 entitled COUPLING AND ROTOR SHAFT FOR MOLTEN METAL DEVICES, U.S. Pat. No. 10,562,097 entitled MOLTEN METAL TRANSFER SYSTEM AND ROTOR, U.S. Pat. No. 10,570,745 entitled ROTARY DEGASSERS AND COMPONENTS THEREFOR, U.S. Pat. No. 10,641,279 entitled MOLTEN METAL ROTOR WITH HARDENED TIP, U.S. Pat. No. 10,641,270 entitled TENSIONED SUPPORT SHAFT AND OTHER MOLTEN METAL DEVICES, and U.S. patent application Ser. Nos. 16/877,267, 16/877,364, 16/877,296, 16/877,332, and 16/877,332, entitled MOLTEN METAL CONTROLLED FLOW LAUNDER, MOLTEN METAL TRANSFER SYSTEM AND METHOD, SYSTEM AND METHOD TO FEED MOLD WITH MOLTEN METAL, SMART MOLTEN METAL PUMP, and SYSTEM FOR MELTING SOLID METAL, all of which were filed on the same date as this Application.

Three basic types of pumps for pumping molten metal, such as molten aluminum, are utilized: circulation pumps, transfer pumps and gas-release pumps. Circulation pumps are used to circulate the molten metal within a bath, thereby generally equalizing the temperature of the molten metal. Circulation pumps may be used in any vessel, such as in a reverbatory furnace having an external well. The well is usually an extension of the charging well, in which scrap metal is charged (i.e., added).

Standard transfer pumps are generally used to transfer molten metal from one structure to another structure such as a ladle or another furnace. A standard transfer pump has a riser tube connected to a pump discharge and supported by the superstructure. As molten metal is pumped it is pushed up the riser tube (sometimes called a metal-transfer conduit) and out of the riser tube, which generally has an elbow at its upper end, so molten metal is released into a different vessel from which the pump is positioned.

Gas-release pumps, such as gas-injection pumps, circulate molten metal while introducing a gas into the molten metal. In the purification of molten metals, particularly aluminum, it is frequently desired to remove dissolved gases such as hydrogen, or dissolved metals, such as magnesium. As is known by those skilled in the art, the removing of dissolved gas is known as "degassing" while the removal of magnesium is known as "demagging." Gas-release pumps may be used for either of both of these purposes or for any other application for which it is desirable to introduce gas into molten metal.

Gas-release pumps generally include a gas-transfer conduit having a first end that is connected to a gas source and a second end submerged in the molten metal bath. Gas is introduced into the first end and is released from the second end into the molten metal. The gas may be released downstream of the pump chamber into either the pump discharge or a metal-transfer conduit extending from the discharge, or into a stream of molten metal exiting either the discharge or the metal-transfer conduit. Alternatively, gas may be released into the pump chamber or upstream of the pump chamber at a position where molten metal enters the pump chamber. The gas may also be released into any suitable location in a molten metal bath.

Molten metal pump casings and rotors often employ a bearing system comprising ceramic rings wherein there are one or more rings on the rotor that align with rings in the pump chamber (such as rings at the inlet and outlet) when the rotor is placed in the pump chamber. The purpose of the bearing system is to reduce damage to the soft, graphite components, particularly the rotor and pump base, during pump operation.

Generally, a degasser (also called a rotary degasser) includes (1) an impeller shaft having a first end, a second end and a passage for transferring gas, (2) an impeller, and (3) a drive source for rotating the impeller shaft and the impeller. The first end of the impeller shaft is connected to the drive source and to a gas source and the second end is connected to the impeller.

Generally a scrap melter includes an impeller affixed to an end of a drive shaft, and a drive source attached to the other end of the drive shaft for rotating the shaft and the impeller. The movement of the impeller draws molten metal and scrap metal downward into the molten metal bath in order to melt the scrap. A circulation pump is preferably used in conjunction with the scrap melter to circulate the molten metal in order to maintain a relatively constant temperature within the molten metal.

The materials forming the components that contact the molten metal bath should remain relatively stable in the bath. Structural refractory materials, such as graphite or ceramics, that are resistant to disintegration by corrosive attack from the molten metal may be used. As used herein "ceramics" or "ceramic" refers to any oxidized metal (including silicon) or carbon-based material, excluding graphite, or other ceramic material capable of being used in the environment of a molten metal bath. "Graphite" means any type of graphite, whether or not chemically treated. Graphite is particularly suitable for being formed into pump components because it is (a) soft and relatively easy to machine, (b) not as brittle as ceramics and less prone to breakage, and (c) less expensive than ceramics.

Ceramic, however, is more resistant to corrosion by molten aluminum than graphite. It would therefore be advantageous to develop vertical members used in a molten metal device that are comprised of ceramic, but less costly than solid ceramic members, and less prone to breakage than normal ceramic.

SUMMARY OF THE INVENTION

A scrap melting system and method includes a vessel that is configured to retain molten metal and a raised surface about the level of molten metal in the vessel. Solid metal is placed on the raised surface and molten metal from the vessel is moved upward from the vessel and across the raised surface to melt at least some of the metal. The molten metal is preferably raised from the vessel to the raised surface by a molten metal pumping device or system. The molten metal moves off of the raised surface and into a vessel of any suitable type, or launder. Any suitable method for moving molten metal onto the raised surface may be used, and the claims are not limited to the exemplary embodiments disclosed herein.

One exemplary embodiment of a system for transferring molten metal onto a raised surface comprises at least (1) a vessel for retaining molten metal, (2) a dividing wall (or overflow wall) within the vessel, the dividing wall having a height H1 and dividing the vessel into at least a first chamber and a second chamber, and (3) a molten metal pump in the vessel, preferably in the first chamber. The system may also include other devices and structures such as one or more of a launder, a third chamber, an additional vessel, a rotary degasser, one or more additional pumps, and a pump control system.

In one embodiment, the second chamber has a wall or opening with a height H2 that is lower than height H1 and the second chamber is juxtaposed the raised surface. The pump (either a transfer, circulation or gas-release pump) is submerged in the first chamber (preferably) and pumps molten metal from the first chamber past the dividing wall and into the second chamber causing the level of molten metal in the second chamber to rise. When the level of molten metal in the second chamber exceeds height H2, molten metal flows out of the second chamber and onto the raised surface onto which solid metal, such as scrap aluminum, has been placed. If a circulation pump, which is most preferred, or a gas-release pump is utilized, the molten metal would be pumped through the pump discharge and through an opening in the dividing wall wherein the opening is preferably completely below the surface of the molten metal in the first chamber.

In addition, preferably the pump used to transfer molten metal from the first chamber to the second chamber is a circulation pump (most preferred) or gas-release pump, preferably a variable speed pump. When utilizing such a pump there is an opening in the dividing wall beneath the level of molten metal in the first chamber during normal operation. The pump discharge communicates with, and may be received partially or totally in the opening. When the pump is operated it pumps molten metal through the opening and into the second chamber thereby raising the level in the second chamber until the level surpasses H2 and flows out of the second chamber.

Further, if the pump is a variable speed pump, which is preferred, a control system may be used to speed or slow the pump, either manually or automatically, as the amount of scrap to the melted, or remaining to be melted, varies.

Utilizing such a variable speed circulation pump or gas-release pump further reduces the chance of splashing and formation or dross, and reduces the chance of lags in which there is no molten metal being transferred or that could cause a device, such as a ladle, to be over filled. It leads to even and controlled transfer of molten metal from the vessel into another device or structure.

The problems with splashing or turbulence, or a difficult to control molten metal flow, are greatly reduced or eliminated by utilizing this system. Molten metal can be smoothly flowed across the raised surface and the level of molten metal raised or lowered as desired to melt the scrap on the raised surface. As solid metal is melted and becomes part of the molten (or liquid) metal, this melt (which includes the original molten metal and the melted, former solid metal) flows past the back, or second, side of the raised surface. From there the melt may enter any suitable structure, such as a launder, another vessel, or another chamber of the same vessel in which the molten metal pump and dividing wall are positioned. The melt may be degassed, such as by a rotary degasser, pumped, or demagged, such as by using a gas-release pump that releases chlorine gas into the melt.

Preferably, before or after the melt moves off the raised surface it is filtered to remove at least some solid particles. The filtering can be done by a grate positioned near or at the rear side of the raised surface. Solid particles that remain on the raised surface are removed, such as by using a steel arm that is lowered onto the raised surface and pulled across the surface to remove the solid particles.

Although one specific system is disclosed herein for raising molten metal to flow across the raised surface, and suitable system, method, or device may be utilized to move molten metal across the raised surface with little splashing or turbulence, and to evenly control the flow across the entire raised surface on which the solid metal is positioned.

DETAILED DESCRIPTION

Figure 1:
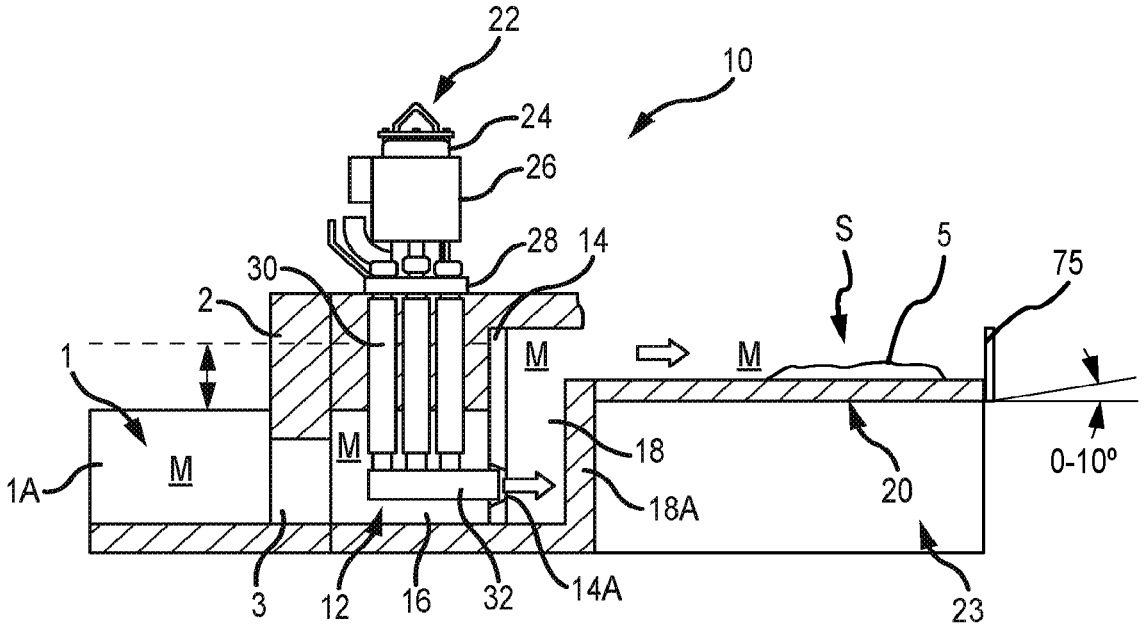
FIG. 1 is a cross-sectional side view of a system according to this disclosure for melting solid metal on a raised surface.

Turning now to the Figures, where the purpose is to describe preferred embodiments of the invention and not to limit same, FIGS. 1-3A show a system 10 for moving molten metal M onto a raised surface 20 in order to melt solid metal, such as aluminum scrap. System 10 includes a furnace 1 that can retain molten metal M, which includes a holding furnace 1A, a vessel 12, a raised surface 20, and a pump 22. System 10 preferably has a vessel 12, a dividing wall 14 to separate vessel 12 into at least a first chamber 16 and a second chamber 18, and a device or structure, which may be pump 22, for generating a stream of molten metal from first chamber 16 into second chamber 18.

Figure 2:
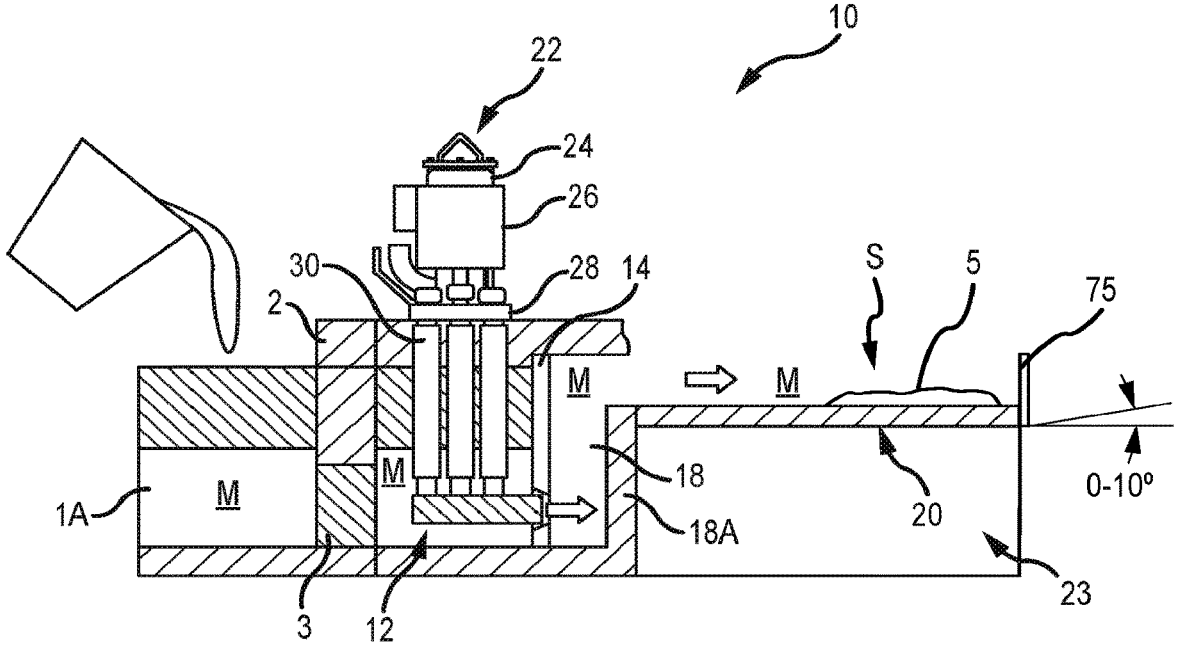
FIG. 2 is the system of FIG. 1 showing the level of molten metal in the furnace being increased.
Figure 11:
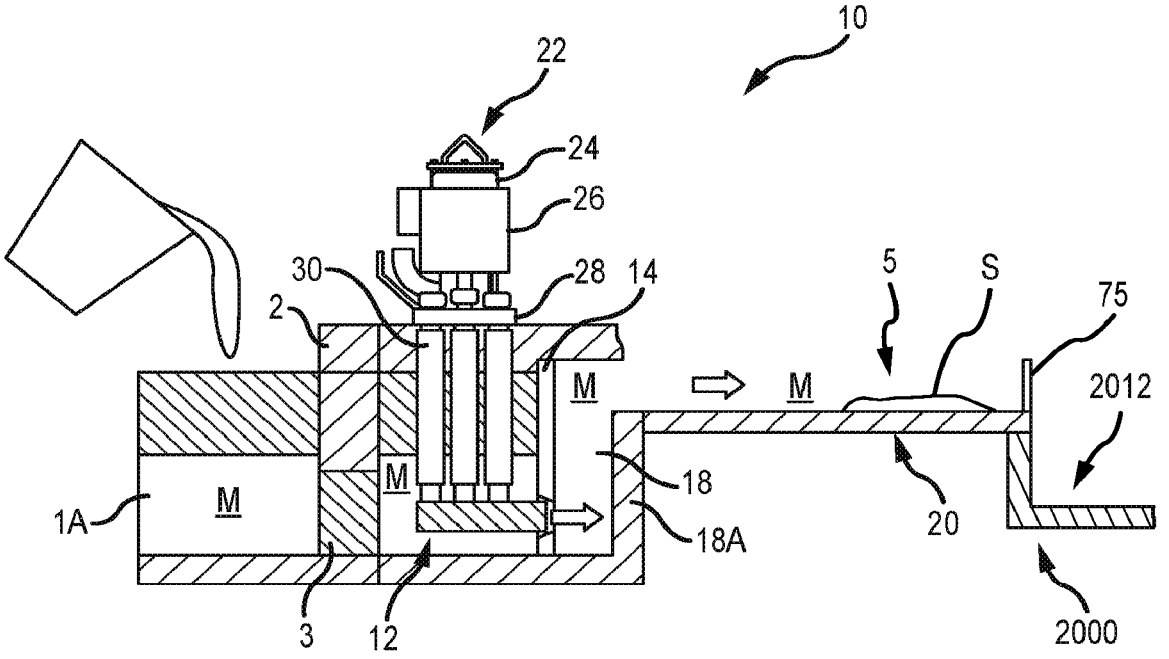
FIG. 11 is a cross-sectional, side view of an embodiment of this disclosure that further includes an additional vessel or chamber.

Using heating elements (not shown in the figures), furnace 1 is raised to a temperature sufficient to maintain the metal therein (usually aluminum or zinc) in a molten state. The level of molten metal M in holding furnace 1A and in at least part of vessel 12 changes as metal is added or removed to furnace 1A, as can be seen in FIGS. 2 and 11.

For explanation, furnace 1 includes a furnace wall 2 having an archway 3. Archway 3 allows molten metal M to flow into vessel 12 from holding furnace 1A. In this embodiment, furnace 1A and vessel 12 are in fluid communication, so when the level of molten metal in furnace 1A rises, the level also rises in at least part of vessel 12. It most preferably rises and falls in first chamber 16, described below, as the level of molten metal rises or falls in furnace 1A. This can be seen in FIGS. 2 and 11.

Dividing wall 14 separates vessel 12 into at least two chambers, a pump well (or first chamber) 16 and a skim well (or second chamber) 18, and any suitable structure for this purpose may be used as dividing wall 14. As shown in this embodiment, dividing wall 14 has an opening 14A and an optional overflow spillway 14B (best seen in FIG. 3), which is a notch or cut out in the upper edge of dividing wall 14. Overflow spillway 14B is any structure suitable to allow molten metal to flow from second chamber 18, past dividing wall 14, and into first chamber 16 and, if used, overflow spillway 14B may be positioned at any suitable location on wall 14. The purpose of optional overflow spillway 14B is to prevent molten metal from overflowing the second chamber 18, or a launder in communication with second chamber 18 (if a launder is used with the invention), by allowing molten metal in second chamber 18 to flow back into first chamber 16. Optional overflow spillway 14B would not be utilized during normal operation of system 10 and is to be used as a safeguard if the level of molten metal in second chamber 18 improperly rises to too high a level.

Figure 2A:
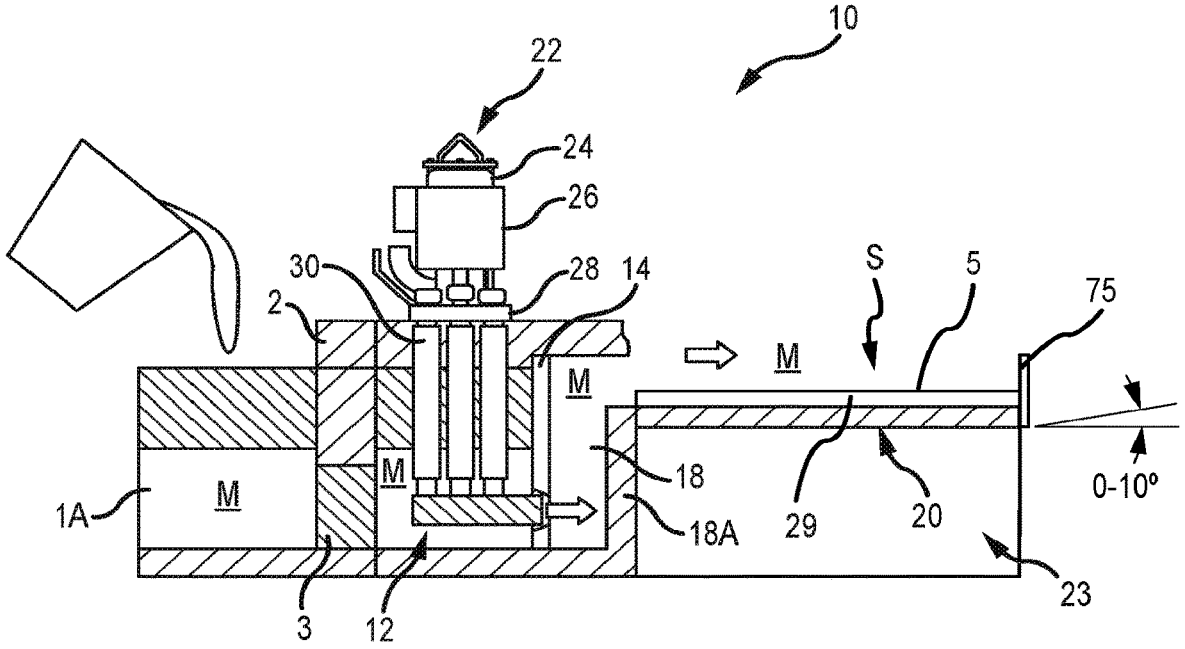
FIG. 2A shows the system of FIG. 1 with side walls on the raised surface that help contain the molten metal.
Figure 2B:
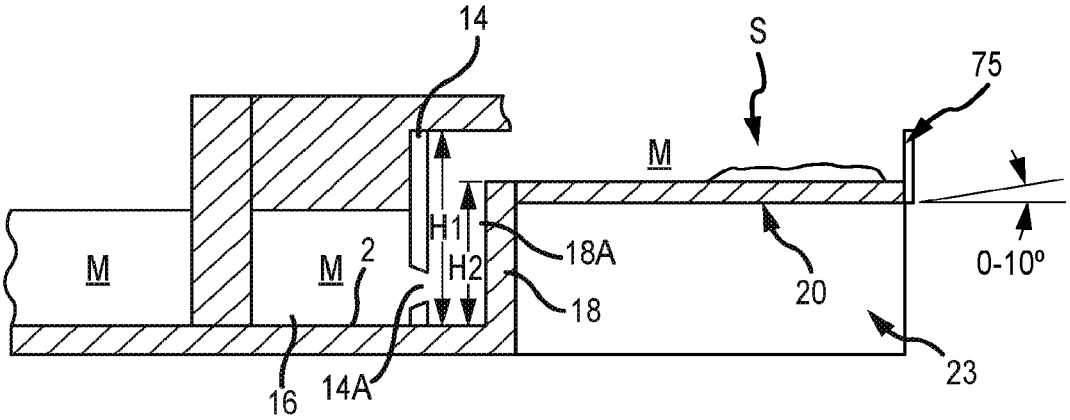
FIG. 2B shows the system of FIGS. 1 and 2 and displays how heights H1 and H2 are determined.
Figure 3:
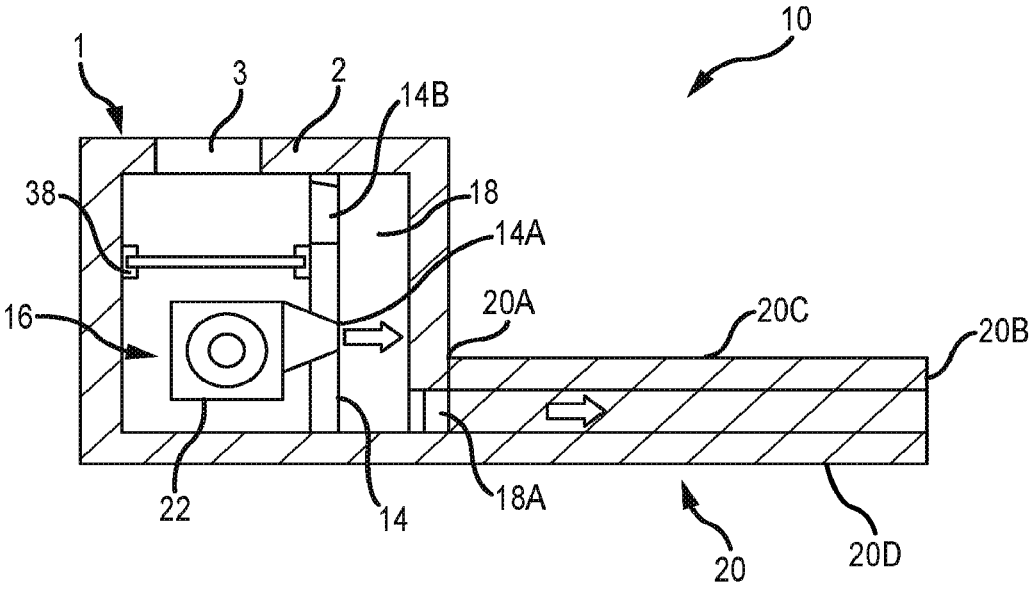
FIG. 3 is a top, partial cross-sectional view of the system of FIG. 2A.
Figure 3A:
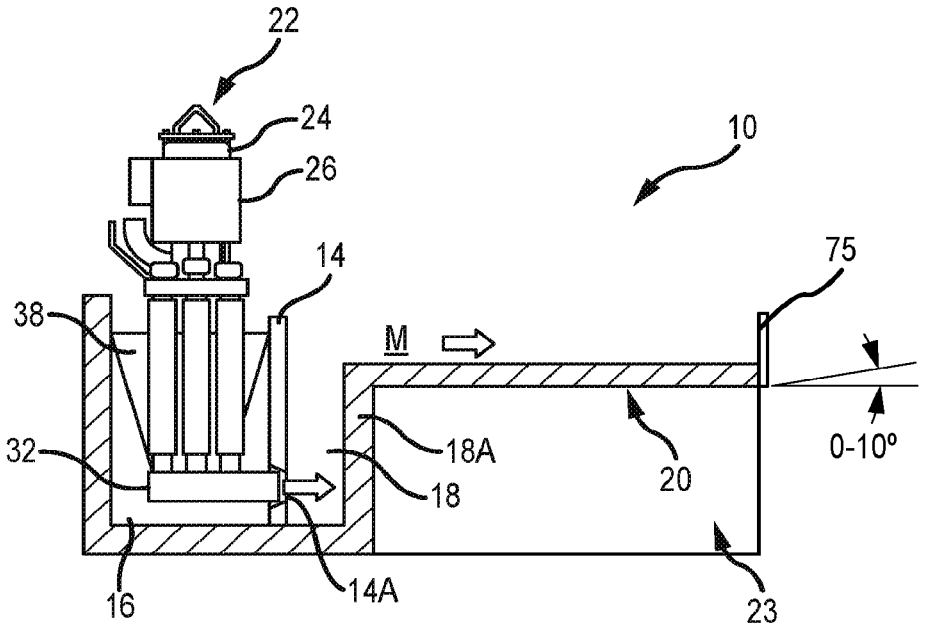
FIG. 3A is a partial, cross-sectional side view of a system according to this disclosure.

At least part of dividing wall 14 has a height H1 (best seen in FIG. 2A), which is the height at which, if exceeded by molten metal in second chamber 18, molten metal flows past the portion of dividing wall 14 at height H1 and back into first chamber 16. In the embodiment shown in FIGS. 1-3A, overflow spillway 14B has a height H1 and the rest of dividing wall 14 has a height greater than H1. Alternatively, dividing wall 14 may not have an overflow spillway, in which case all of dividing wall 14 could have a height H1, or dividing wall 14 may have an opening with a lower edge positioned at height H1, in which case molten metal could flow through the opening if the level of molten metal in second chamber 18 exceeded H1. H1 should exceed the highest level of molten metal in first chamber 16 during normal operation.

Second chamber 18 has a portion 18A, which has a height H2, wherein H2 is less than H1 (as can be best seen in FIG. 2A) so during normal operation molten metal pumped into second chamber 18 flows past wall 18A and out of second chamber 18 rather than flowing back over dividing wall 14 and into first chamber 16.

Dividing wall 14 may also have an opening 14A that is located at a depth such that opening 14A is submerged within the molten metal during normal usage, and opening 14A is preferably near or at the bottom of dividing wall 14. Opening 14A preferably has an area of between 6 in.$^2$ and 24 in.$^2$, but could be any suitable size. Further, dividing wall 14 need not have an opening if a transfer pump were used to transfer molten metal from first chamber 16, over the top of wall 14, and into second chamber 18 as described below.

Dividing wall 14 may also include more than one opening between first chamber 16 and second chamber 18 and opening 14A (or the more than one opening) could be positioned at any suitable location(s) in dividing wall 14 and be of any size(s) or shape(s) to enable molten metal to pass from first chamber 16 into second chamber 18.

Molten metal pump 22 may be any device or structure capable of pumping or otherwise conveying molten metal, and may be a transfer, circulation or gas-release pump. Pump 22 is preferably a circulation pump (most preferred) or gas-release pump that generates a flow of molten metal from first chamber 16 to second chamber 18 through opening 14A. Pump 22 generally includes a motor 24 surrounded by a cooling shroud 26, a superstructure 28, support posts 30 and a base 32. Some pumps that may be used with the invention are shown in U.S. Pat. Nos. 5,203,681, 6,123,523 and 6,354,964 to Cooper, and pending U.S. application Ser. No. 10/773,101 to Cooper. Molten metal pump 22 can be a constant speed pump, but is most preferably a variable speed pump. Its speed can be varied depending on the amount of molten metal in a structure such as a ladle or launder, as discussed below.

Utilizing system 10, as pump 22 pumps molten metal from first chamber 16 into second chamber 18, the level of molten metal in chamber 18 rises. When a pump with a discharge submerged in the molten metal bath, such as circulation pump or gas-release pump is utilized, there is essentially no turbulence or splashing during this process, which reduces the formation of dross and reduces safety hazards. The flow of molten metal is smooth and generally at an even flow rate.

A system according to this disclosure could also include one or more pumps in addition to pump 22, in which case the additional pump(s) may circulate molten metal within first chamber 16 and/or second chamber 18, or from chamber 16 to chamber 18, and/or may release gas into the molten metal first in first chamber 16 or second chamber 18. For example, first chamber 16 could include pump 22 and a second pump, such as a circulation pump or gas-release pump, to circulate and/or release gas into molten metal M.

If pump 22 is a circulation pump or gas-release pump, it is at least partially received in opening 14A in order to at least partially block opening 14A in order to maintain a relatively stable level of molten metal in second chamber 18 during normal operation and to allow the level in second chamber 18 to rise independently of the level in first chamber 16. Utilizing this system the movement of molten metal from one chamber to another and from the second chamber into a launder does not involve raising molten metal above the molten metal surface. As previously mentioned this alleviates problems with blockage forming (because of the molten metal cooling and solidifying), and with turbulence and splashing, which can cause dross formation and safety problems. As shown, part of base 32 (preferably the discharge portion of the base) is received in opening 14A. Further, pump 22 may communicate with another structure, such as a metal-transfer conduit, that leads to and is received partially or fully in opening 14A. Although it is preferred that the pump base, or communicating structure such as a metal-transfer conduit, be received in opening 14A, all that is necessary for the invention to function is that the operation of the pump increases and maintains the level of molten metal in second chamber 18 so that the molten metal ultimately moves out of chamber 18 and into another structure. For example, the base of pump 22 may be positioned so that its discharge is not received in opening 14A, but is close enough to opening 14A that the operation of the pump raises the level of molten metal in second chamber 18 independent of the level in chamber 16 and causes molten metal to move out of second chamber 18 and into another structure. A sealant, such as cement (which is known to those skilled in the art), may be used to seal base 32 into opening 14A, although it is preferred that a sealant not be used.

A system according to this disclosure could also be operated with a transfer pump, although a pump with a submerged discharge, such as a circulation pump or gas-release pump, is preferred since either would be less likely to create turbulence and dross in second chamber 18, and neither raises the molten metal above the surface of the molten metal bath nor has the other drawbacks associated with transfer pumps that have previously been described. If a transfer pump were used to move molten metal from first chamber 16, over dividing wall 14, and into second chamber 18, there would be no need for opening 14A in dividing wall 14, although an opening could still be provided and used in conjunction with an additional circulation or gas-release pump. As previously described, regardless of what type of pump is used to move molten metal from first chamber 16 to second chamber 18, molten metal would ultimately move out of chamber 18 and into a structure, such as ladle 52 or launder 20, when the level of molten metal in second chamber 18 exceeds H2.

Once pump 22 is turned off, the respective levels of molten metal level in chambers 16 and 18 essentially equalize. Alternatively, the speed of pump 22 could be reduced to a relatively low speed to keep the level of molten metal in second chamber 18 relatively constant but not exceed height H2. To move molten metal onto raised surface 20, pump 22 is simply turned on again and operated as described above.

A system for melting scrap according to this disclosure includes a molten metal pump and a raised surface 20 on which solid metal S, such as scrap aluminum, can be positioned, wherein molten metal is flowed onto and across the raised surface 20 in order to melt at least some of the solid metal S. As described above, the pump 22 generates a flow of molten metal M from first chamber 16 into second chamber 18. When the level of molten metal M in second chamber 18 exceeds H2, the molten metal moves out of second chamber 18 and onto the raised surface 20 to melt scrap placed on surface 20. The level of molten metal M in the second chamber 18 rises until it flows onto raised surface 20, and flows along the raised surface 20 until it melts at least some of the solid metal S on the raised surface 20 melts. The amount of molten metal flowed across raised surface 20 can be varied based on any suitable factor, such as based on the amount of solid metal S on raised surface 20.

The raised surface 20 has a first side 20A adjacent the second chamber 18 and a second side 20B. Raised surface 20 can be the upper surface of a refractory block 23, which may be inside or outside of vessel 1. A refractory grate 75 is preferably positioned at, or just before or just after, second side 20B. The refractory grate 75 acts as a filter that blocks pieces of unmelted metal, such as pieces of iron or steel, from being mixed with the molten metal M and moving off of raised surface 20. Any suitable filter could be used for this purpose.

Preferably, before or after the melt moves off the raised surface 20 it is filtered to remove at least some solid particles. The filtering can be done by grate 75. Solid particles, such as iron or steel, that remain on the raised surface 20 are removed, such as by using a steel arm that is lowered onto the raised surface 20 and pulled across the raised surface 20 to remove the solid particles. The method of adding solid metal S and melting it can then be repeated.

Figure 1A:
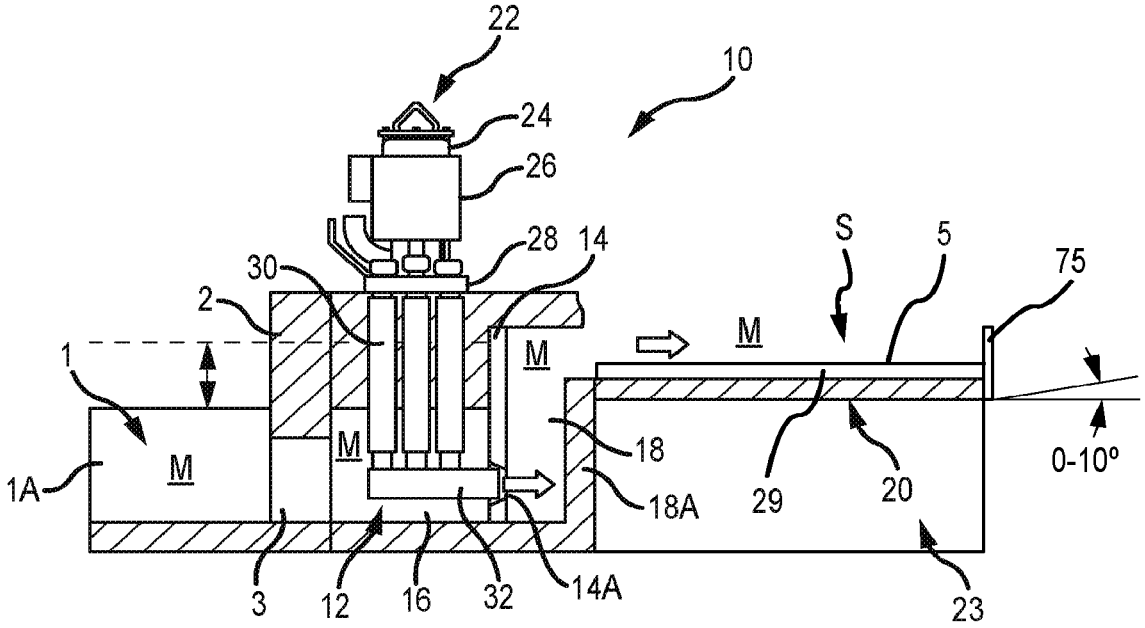
FIG. 1A is a cross-sectional side view of a system according to this disclosure for melting solid metal on a raised surface and that includes one or more side walls.

The raised surface 20 may also include one or more side walls 29 (as shown, for example, in FIG. 1A) that help retain molten metal on the raised surface.

Figure 10:
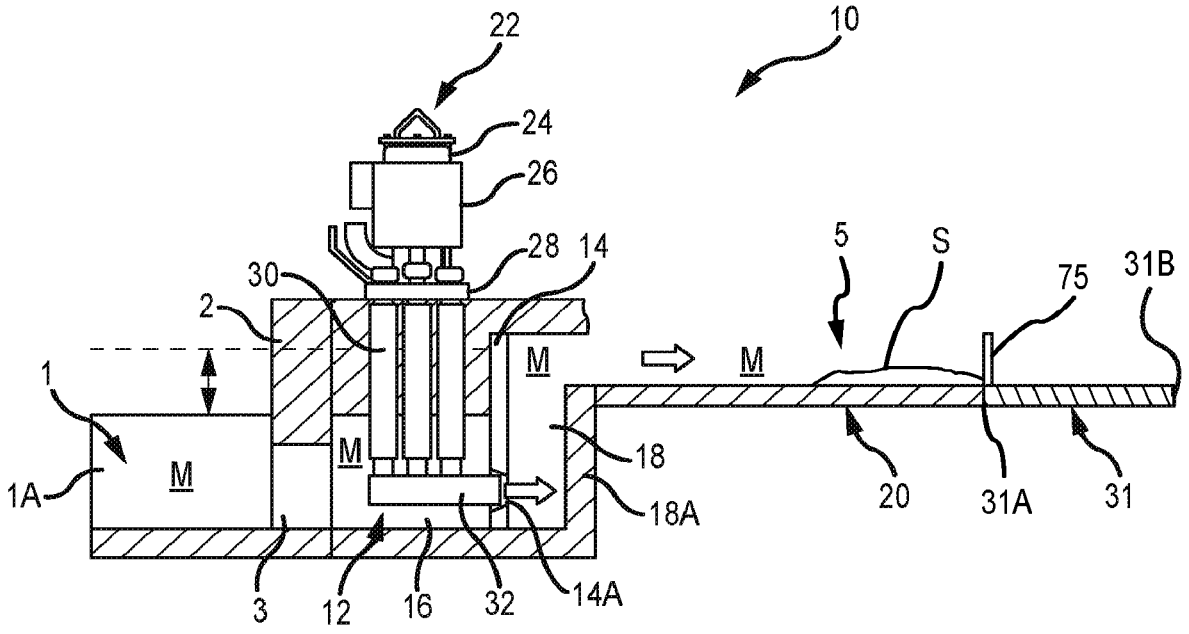
FIG. 10 is a cross-sectional, side view of an embodiment of this disclosure that further includes a launder.

The molten metal M could pass from the raised surface 20 into another vessel or chamber 2000, or move into a launder 31 (as shown in FIG. 10) or any suitable structure.

Furthermore, molten metal can be moved across the raised surface 20 in any suitable manner, such as by using pumping and transfer devices incorporated by reference herein. The specific system described herein using a dividing wall, however, is most preferred because the flow of molten metal can be carefully controlled and spread over a large area, in order to cover the width of the raised surface 20 or a large portion of the width of the raised surface 20.

Although one specific system is disclosed herein for raising molten metal to flow across the raised surface, and suitable system, method, or device may be utilized to move molten metal across the raised surface with little splashing or turbulence, and to evenly control the flow across the entire raised surface on which the solid metal is positioned.

The problems with splashing or turbulence, or a difficult to control molten metal flow, are greatly reduced or eliminated by utilizing this system. Molten metal M can be smoothly flowed across the raised surface 20 and the level of molten metal M raised or lowered as desired to melt the solid metal S on the raised surface 20. As solid metal S is melted and becomes part of the molten (or liquid) metal, this melt (which includes the original molten metal and the melted, former solid metal) flows past the back, or second, side 20B of the raised surface 20. From there the melt may enter any suitable structure, such as a launder 31, another vessel, or another chamber of the same vessel, 2000 in which the molten metal pump and dividing wall are positioned. The melt may be degassed, such as by a rotary degasser, pumped, or demagged, such as by using a gas-release pump that releases chlorine gas into the melt.

As shown in FIG. 10, launder 31 is any structure or device for transferring molten metal from raised surface 20 to one or more structures, such as one or more ladles, molds (such as ingot molds) or other structures in which the molten metal is ultimately cast into a usable form, such as an ingot. Launder 31 may be either an open or enclosed channel, trough or conduit and may be of any suitable dimension or length, such as one to four feet long, or as much as 100 feet long or longer. Launder 31 may be completely horizontal or may slope gently upward or downward. Launder 31 may have one or more taps (not shown), i.e., small openings stopped by removable plugs. Each tap, when unstopped, allows molten metal to flow through the tap into a ladle, ingot mold, or other structure. Launder 31 may additionally or alternatively be serviced by robots or cast machines capable of removing molten metal M from launder 31.

Launder 31 has a first end 31A juxtaposed the second end 20B of raised surface 20 and a second end 31B that is opposite first end 31B. An optional stop may be included in a launder according to the invention. The stop, if used, is preferably juxtaposed the second end 31B of the launder. If launder 31 has a stop, the stop can be opened to allow molten metal to flow past end 31B, or closed to prevent molten metal from flowing past end 31B. The stop preferably has a height H3 greater than height H1 so that if launder 31 becomes too filled with molten metal, the molten metal would back up on raised surface 20, and spill back over dividing wall 14A (over spillway 14B, if used) rather than overflow raised surface 20 and launder 31.

Figure 4:
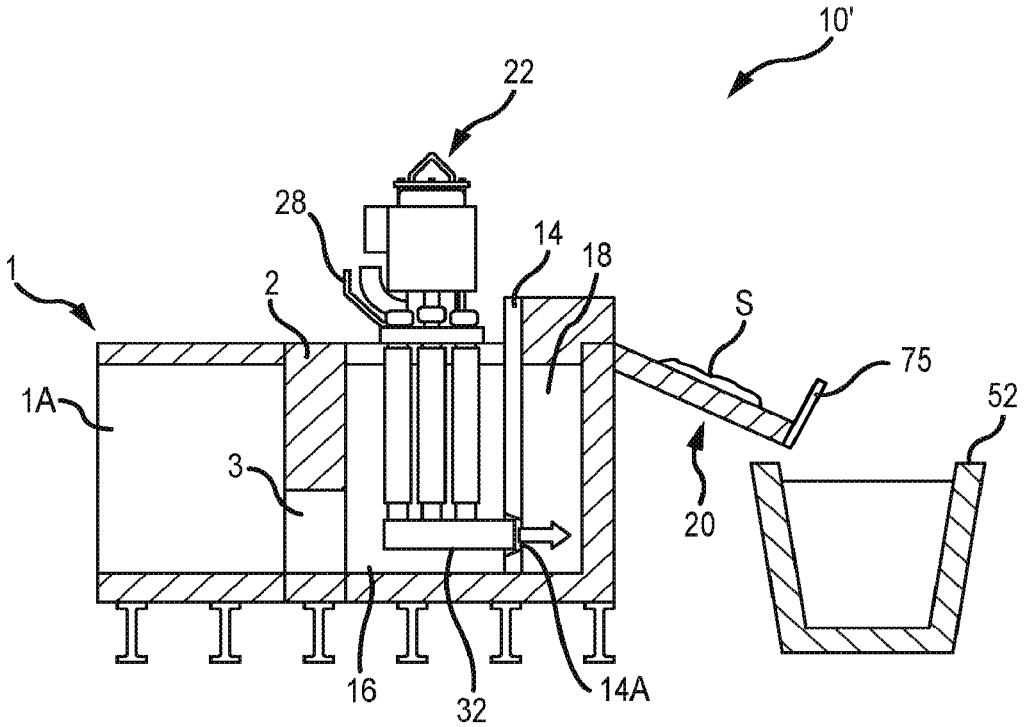
FIG. 4 is a partial, cross-sectional side view of a system according to this disclosure that is utilized to fill a ladle.
Figure 5:
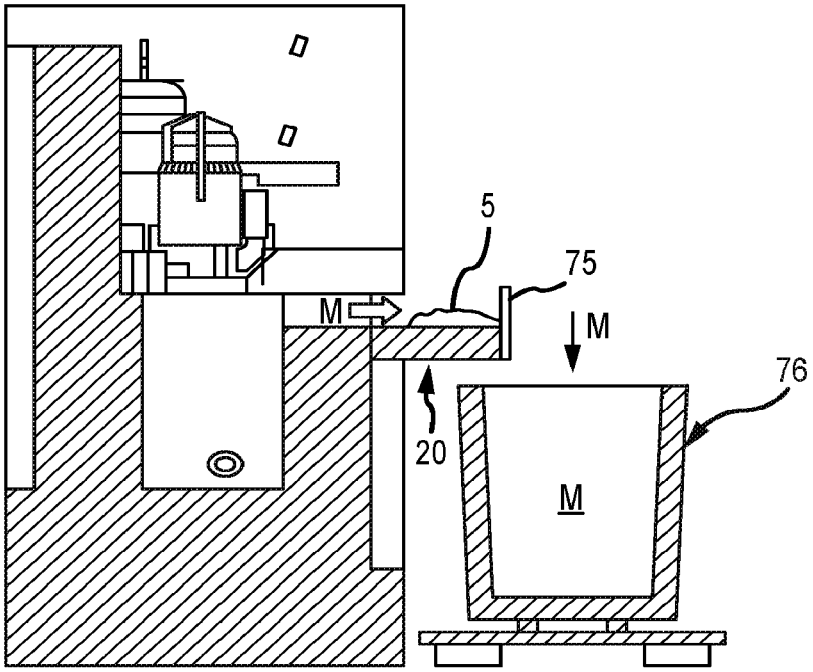
FIG. 5 is a partial, cross-sectional side view of an alternate embodiment of the present disclosure.
Figure 6:
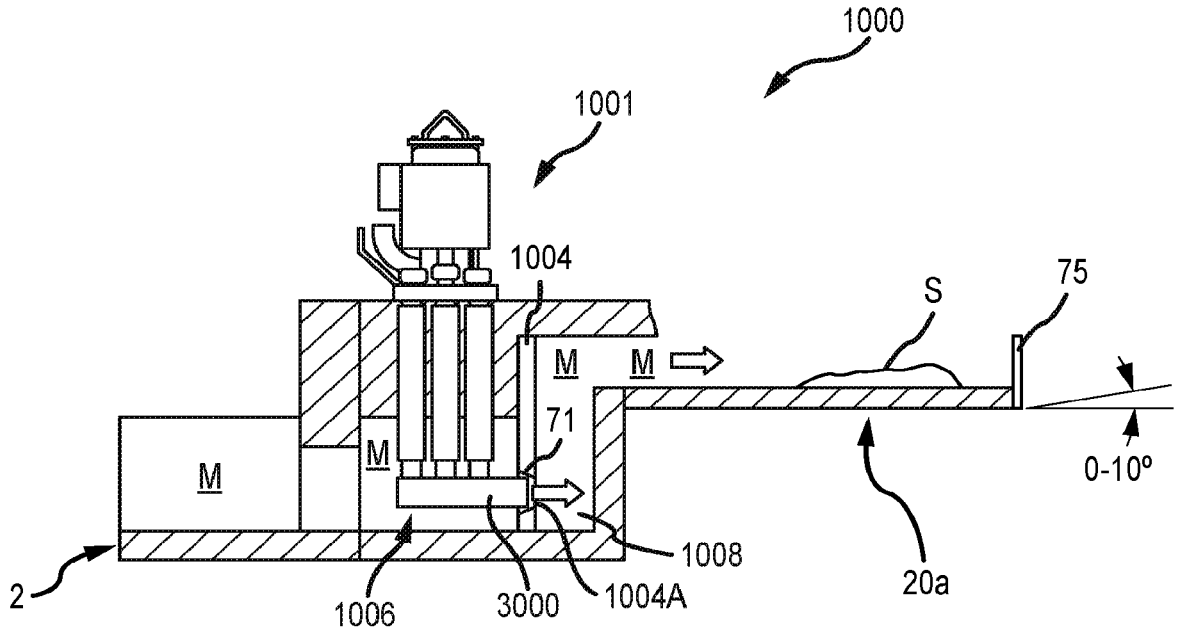
FIG. 6 is a partial cross-sectional, side view of an embodiment of this disclosure.
Figure 7:
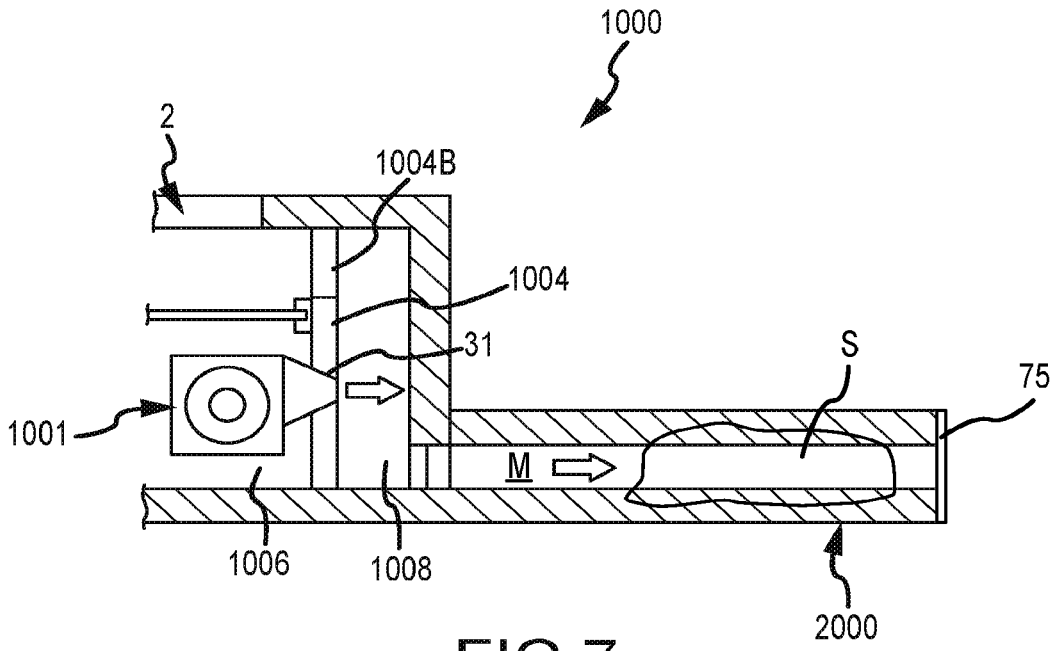
FIG. 7 is a top, partial cross-sectional view of the embodiment of FIG. 6 with a pump.
Figure 8:
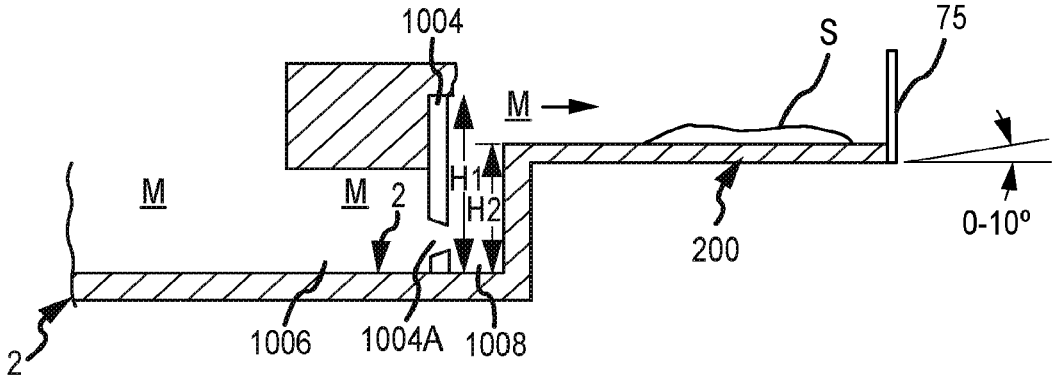
FIG. 8 is a partial side, cross-sectional view of the system of FIG. 6.
Figure 9:
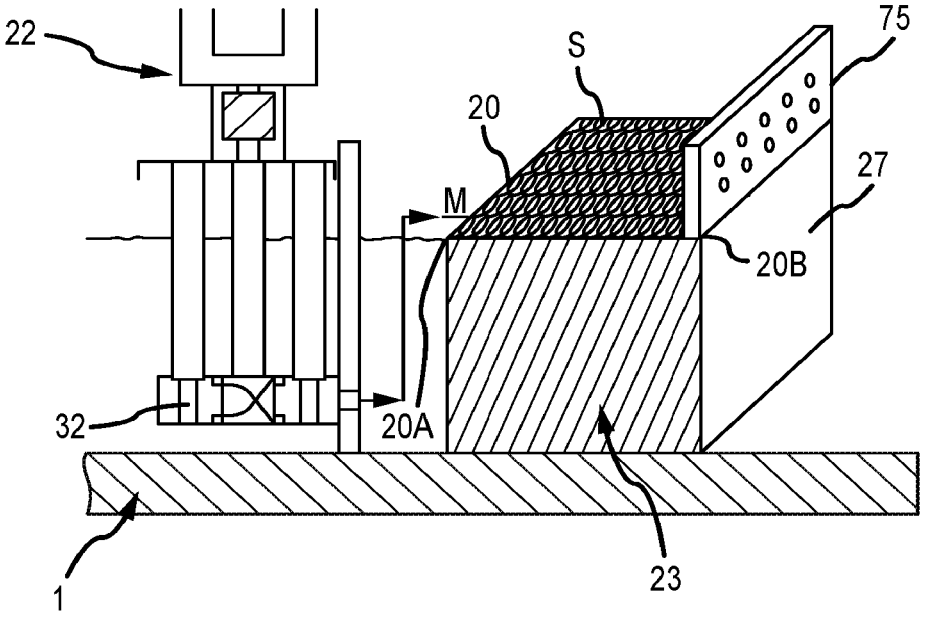
FIG. 9 is a partial perspective, side view of a system according to this disclosure.

FIG. 4 shows an alternate system 10' that is in all respects the same as system 10 except that it has a shorter, downward, sloping surface 20' for retaining solid metal to be melted, a wall 18A' past which molten metal moves when it exits second chamber 18 and it fills a ladle 52.

Figure 12:
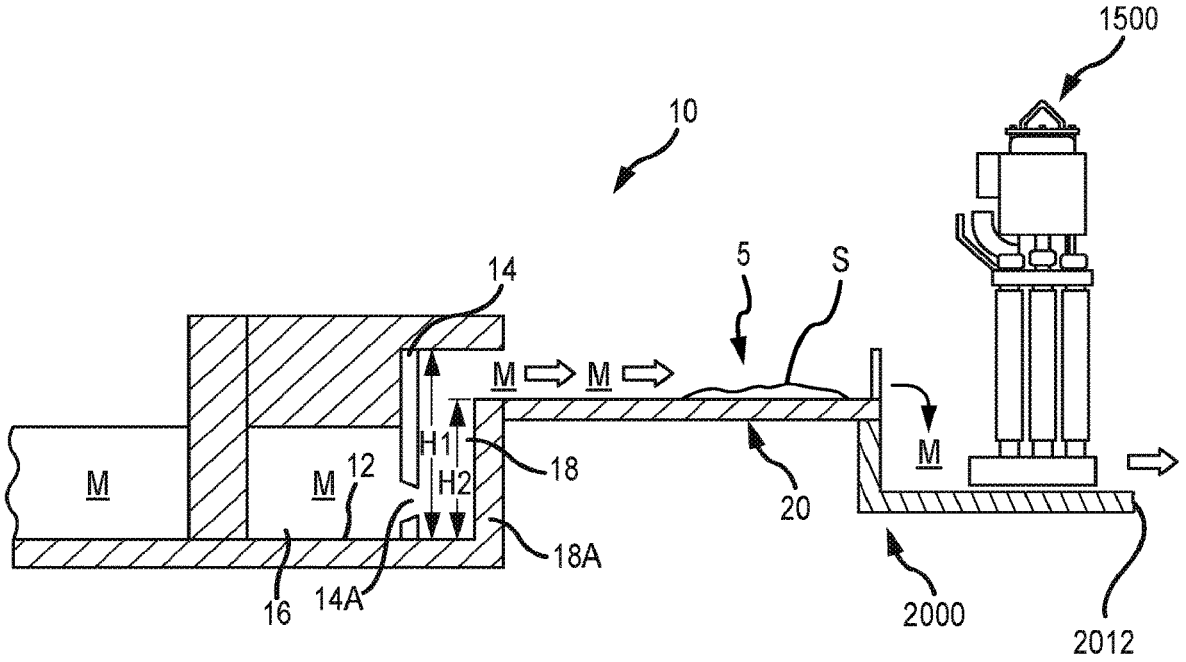
FIG. 12 is a side, cross-sectional view of an alternate system of this disclosure that includes an additional vessel or chamber that has a molten metal pump.

FIG. 12 shows an alternate system 10 that is in all respects the same as system 10 except that it includes an optional second pump 1500 in a third chamber, or second vessel, 2000 having a basin 2012.

Figure 13:
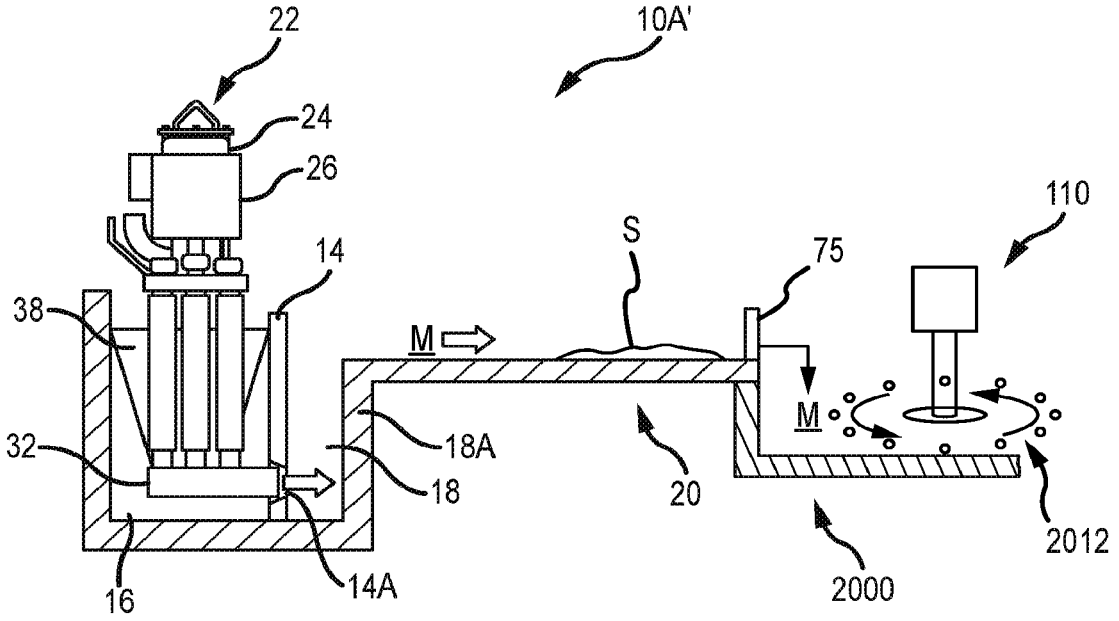
FIG. 13 is a side, cross-sectional view of an alternate system of this disclosure that includes an additional vessel or chamber that has a rotary degasser.

FIG. 13 shows an alternate system 10K that is in all respects the same as system 10 except that it includes an optional rotary degasser 110 in a third chamber, or second vessel, 2000 having a basin 2012.

Some non-limiting examples of this disclosure are as follows:

Example 1: A method for melting solid aluminum utilizing a system that comprises:

a vessel having a first chamber, a second chamber, and a raised surface;

a molten metal pump in the first vessel;

a first dividing wall between the first chamber and second chamber, the first dividing wall having a first height, and an opening that is beneath the height; and a second dividing wall between the second chamber and a raised surface, the second dividing wall having a second height that is less than the first height;

wherein the method comprises the following steps:

placing solid aluminum on the raised surface; and operating the pump to move molten metal through the opening in the first dividing wall, so that the molten metal exceeds the second height and flows across the raised surface until at least some of the solid aluminum is melted into melted aluminum.

Example 2: The method of claim 1, wherein the system further comprises a grate at the rear side of the raised surface, and a melt comprising at least most of the molten metal and melted aluminum passes through the grate.

Example 3: The method of claim 1 that further includes the step of moving the molten metal from the raised surface and into a launder.

Example 4: The method of claim 1 that further includes the step of moving the molten metal from the raised surface and into a third chamber.

Example 5: The method of claim 1 that further includes the step of stopping the flow of molten metal across the raised surface after at least some of the solid aluminum on the surface is melted.

Example 6: The method of claim 1 that further includes the step of removing unmelted pieces of metal from the raises surface.

Example 7: The method of claim 5 that further includes the step of removing unmelted pieces of metal from the raised surface after stopping the flow of molten metal across the raised surface.

Example 8: The method of claim 4 that further includes the step of pumping the molten metal in the third chamber.

Example 9: The method of claim 4 that further includes the step of degassing the molten metal in the third chamber.

Example 10: The method of claim 1 that further includes the step of moving the molten metal from the raised surface and into a third chamber.

Example 11: The method of claim 1 that further includes the step of stopping the flow of molten metal across the raised surface after at least some of the solid aluminum on the surface is melted.

Example 12: The method of claim 1 that further includes the step of removing unmelted pieces of metal from the raises surface.

Example 13: A method of melting metal scrap, Example 1: The method comprising the steps of:

placing solid metal on a raised surface, wherein the surface will not melt at the melting temperature of the solid metal;

moving molten metal across the raised surface in order to melt at least some of the solid metal; and removing solid pieces that did not melt from the raised surface.

Example 14: The method of claim 13, wherein the solid metal and liquid metal are the same metal.

Example 15: The method of claim 13, wherein the solid metal and liquid metal are both aluminum.

Example 16: The method of claim 13 that further includes the step of not moving molten metal across the raised surface after at least some of the solid metal has been melted.

Example 17: The method of claim 13 that further includes the step of filtering the melt.

Example 18: The method of claim 13 that further includes the step of filtering the melt before it moves off the raised surface.

Example 19: The method of claim 13 that further includes the step of moving the molten metal into either a launder or a vessel after it moves past the raised surface.

Example 20: The method of claim 13 that further includes the step of moving the molten metal into a vessel and pumping the molten metal.

Example 21: The method of claim 13 that further includes the step of moving the molten metal from the raised surface and into a third chamber.

Example 22: The method of claim 13 that further includes the step of stopping the flow of molten metal across the raised surface after at least some of the solid aluminum on the surface is melted.

Example 23: The method of claim 13 that further includes the step of removing unmelted pieces of metal from the raised surface.

Example 24: The method of claim 1 wherein the pumping is not continuous.

Example 25: The method of claim 1 wherein the pumping is performed by a transfer pump.

Example 26: The method of claim 1 wherein the pumping is performed by a circulation pump.

Example 27: The method of claim 1 wherein the pumping is performed by a gas-release pump.

Example 28: The method of claim 1 wherein the dividing wall has an opening to permit molten metal to be pumped from the first chamber through the opening and into the second chamber.

Example 29: The method of claim 28 wherein the pump has a pump base and a discharge, and the dividing wall has an opening to permit molten metal to be pumped from the first chamber through the opening and into the second chamber, the discharge being aligned with the opening so that at least some of the molten metal exiting the discharge passes through the opening.

Example 30: The method of claim 1 wherein the pumping is performed at a speed, and the speed is variable.

Example 31: The method of claim 1 wherein the pumping is performed at a speed, and the speed is constant.

Having thus described different embodiments of the invention, other variations and embodiments that do not depart from the spirit thereof will become apparent to those skilled in the art. The scope of the present invention is thus not limited to any particular embodiment, but is instead set forth in the appended claims and the legal equivalents thereof. Unless expressly stated in the written description or claims, the steps of any method recited in the claims may be performed in any order capable of yielding the desired product or result.

What is claimed is:

1. A method of melting metal scrap, the method comprising the steps of:

(a) placing solid metal onto a raised surface, wherein the raised surface has a first side juxtaposed the vessel and a second side opposite the first side, and the molten metal moves from the first side to the second side, and the raised surface will not melt at the melting temperature of the solid metal;

(b) moving molten metal across the raised surface from the first side to the second side in order to melt at least some of the solid metal to additional molten metal; and (c) removing solid pieces that did not melt from the raised surface, wherein the second side is juxtaposed another vessel and the molten metal that moves to the second side passes the second side and enters the another vessel.

2. The method of claim 1, wherein the solid metal and molten metal are the same type of metal.

3. The method of claim 1, wherein the solid metal and molten metal are both aluminum.

4. The method of claim 1 that further includes a step of filtering the at least some of the molten metal before it enters the another vessel.

5. The method of claim 1 that further includes a step of filtering the molten metal before it moves off the raised surface.

6. The method of claim 1, wherein the step of moving the molten metal is performed by a pump pumping the molten metal.

7. The method of claim 1 that further includes the step of pumping the molten metal in the another vessel to circulate the molten metal in the another vessel.

8. The method of claim 1 that further includes the step of stopping the flow of molten metal across the raised surface after at least some of the solid metal on the surface is melted.

9. The method of claim 6, wherein the pumping is not continuous.

10. The method of claim 6, wherein the pumping is performed by a transfer pump.

11. The method of claim 6, wherein the pumping is performed by a circulation pump.

12. The method of claim 6, wherein the pumping is performed by a gas-release pump.

13. The method of claim 1, wherein the vessel has a dividing wall with an opening to permit molten metal to be pumped from a first chamber through the opening and into a second chamber.

14. The method of claim 11, wherein the pump has a pump base and a discharge, and that further includes a dividing wall in the vessel, wherein the dividing wall has an opening to permit molten metal to be pumped from a first chamber through the opening and into a second chamber, the discharge being aligned with the opening so that at least some of the molten metal exiting the discharge passes through the opening.

15. The method of claim 14, wherein the discharge has a snout configured to be at least partially received in the opening.

16. The method of claim 15 that further includes the step of positioning the pump in the vessel with the snout positioned at least partially in the opening.

* * * * *